US005113990A

United States Patent [19]

Gabrius et al.

[11] Patent Number: 5,113,990

[45] Date of Patent: May 19, 1992

[54] BILL VALIDATION AND CHANGE SYSTEM FOR A SLOT MACHINE

[75] Inventors: A. J. Gabrius, Carol Stream; Robert C. Mesh, Schiller Park; Arthur Brey, Des Plaines; Daniel Hartogh, Morton Grove, all of Ill.

[73] Assignee: Bally Manufacturing Corporation, Chicago, Ill.

[21] Appl. No.: 394,258

[22] Filed: Aug. 15, 1989

Related U.S. Application Data

[63] Continuation of Ser. No. 118,090, Nov. 6, 1987, abandoned, which is a continuation-in-part of Ser. No. 829,298, Feb. 12, 1986, abandoned.

[51] Int. Cl.[5] ..... G07F 7/04; G07F 17/34

[52] U.S. Cl. ..... 194/206; 194/217; 194/350; 273/138 A; 364/412

[58] Field of Search ..... 194/206, 207, 217, 218, 194/346, 350, 202, 204; 273/138 A, 143 R, 143 B, 143 C, 143 D, 143 E; 364/410, 412, 479; 453/2, 17

[56] References Cited

U.S. PATENT DOCUMENTS

| | | | |
|---|---|---|---|
| 2,896,763 | 7/1959 | Gisser et al. | 194/4 |
| 3,608,690 | 9/1971 | Morrow et al. | 194/206 |
| 3,635,321 | 1/1972 | Frazier, Sr. | 194/207 |
| 3,757,917 | 9/1973 | Watwood et al. | 194/218 |
| 3,768,616 | 10/1973 | Dykehouse et al. | 194/206 |
| 3,770,089 | 11/1973 | Verduin et al. | 194/1 N |
| 3,783,989 | 1/1974 | Jensen | 194/351 X |
| 3,870,629 | 3/1975 | Carter et al. | 209/111.8 |
| 3,934,692 | 1/1976 | Novak et al. | 194/4 |
| 4,033,588 | 7/1977 | Watts | 273/138 |
| 4,095,795 | 6/1978 | Saxton et al. | 273/138 A X |
| 4,188,961 | 2/1980 | Heiman | 194/216 X |
| 4,238,127 | 12/1980 | Lucero et al. | 273/143 R |
| 4,240,635 | 12/1980 | Brown | 364/410 |
| 4,282,892 | 8/1981 | Burnside | 133/1 R |
| 4,283,708 | 8/1981 | Lee | 340/146.3 |
| 4,299,388 | 11/1981 | Resch et al. | 273/143 R |
| 4,349,111 | 9/1982 | Shah et al. | 209/534 |
| 4,361,161 | 11/1982 | Johnson | 133/3 R |
| 4,376,479 | 3/1983 | Sugimoto et al. | 194/218 |
| 4,381,835 | 5/1983 | Shah et al. | 194/217 |
| 4,392,564 | 7/1983 | Hayashi | 194/218 |
| 4,462,512 | 7/1984 | Schuller | 194/217 |
| 4,470,496 | 9/1984 | Steiner | 194/206 X |
| 4,499,982 | 2/1985 | Sugimoto et al. | 194/218 X |
| 4,499,985 | 2/1985 | Schuller | 194/217 |
| 4,503,963 | 3/1985 | Steiner | 194/4 |
| 4,512,453 | 4/1985 | Schuller et al. | 194/217 X |
| 4,513,439 | 4/1985 | Gorgone et al. | 382/7 |
| 4,540,081 | 9/1985 | Mori et al. | 194/207 |
| 4,541,444 | 9/1985 | Okada | 453/17 |
| 4,587,084 | 5/1986 | Levasseur et al. | 194/216 X |
| 4,607,844 | 8/1986 | Fullerton | 273/138 A |

FOREIGN PATENT DOCUMENTS

| | | | |
|---|---|---|---|
| 1227522 | 4/1971 | United Kingdom . | |
| 1235651 | 6/1971 | United Kingdom . | |
| 1348309 | 3/1974 | United Kingdom . | |
| 1424775 | 2/1976 | United Kingdom . | |
| 1484858 | 9/1977 | United Kingdom . | |
| 1531311 | 11/1978 | United Kingdom . | |
| 2105508 | 3/1983 | United Kingdom . | |
| 2112985 | 7/1983 | United Kingdom . | |
| 2117954 | 10/1983 | United Kingdom . | |
| 2134297 | 8/1984 | United Kingdom . | |
| 2170937 | 8/1986 | United Kingdom | 194/217 |
| 2181876 | 4/1987 | United Kingdom . | |
| 2186412 | 8/1987 | United Kingdom . | |

*Primary Examiner*—F. J. Bartuska

*Attorney, Agent, or Firm*—Jenner & Block

[57] ABSTRACT

A bill validation and change system for a slot machine. The system accepts bills of a plurality of denominations and pays out change for the bills in coins of the denomation which may be accepted by the slot machine to play a game. Coins input to the slot machine are stored in a coin hopper which is controlled to payout coins to game winners and to make change for bills. The system includes a master processor which determines winning game plays and whether change for a bill should be made. The master processor further controls the coin hopper to payout coins to winners and to make change for a bill. The master processor is coupled to a slave processor which in conjunction with a bill input device determines the validity and denomination of a received bill. The slave processor controls the bill input device to accept valid bills for which the master processor determines that change should be made and to reject other bills.

105 Claims, 12 Drawing Sheets

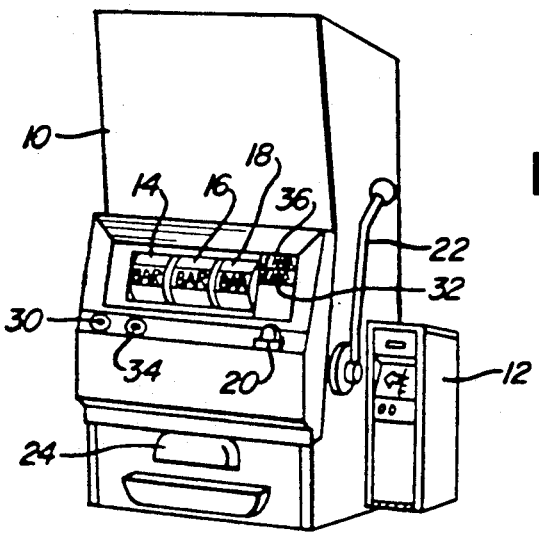
Fig. 1
Fig. 2
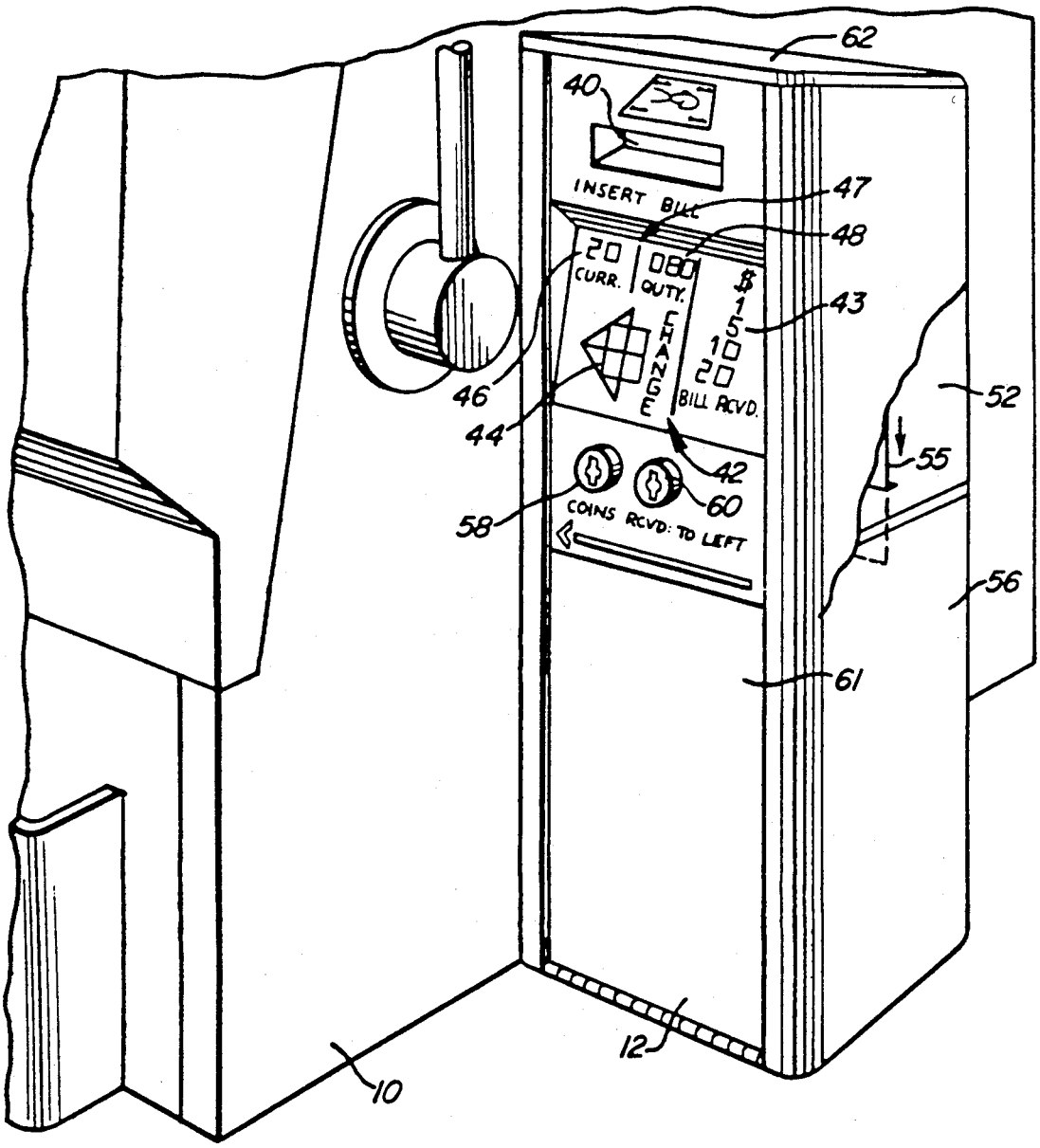

Fig. 7
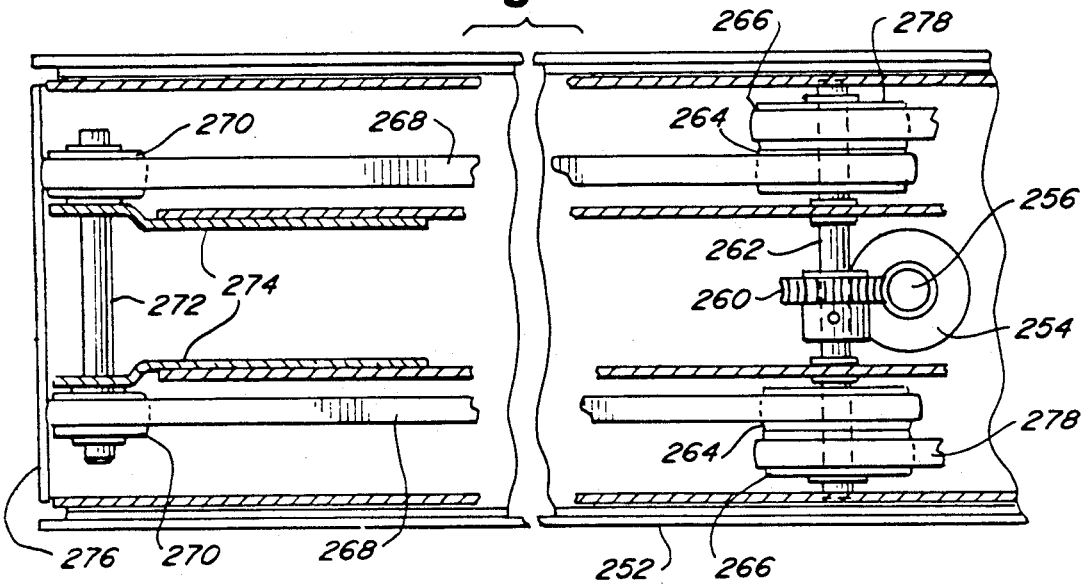
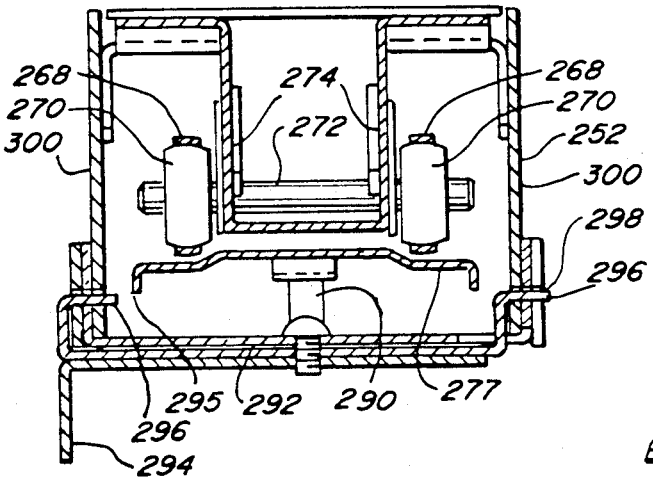
Fig. 8
Fig. 9
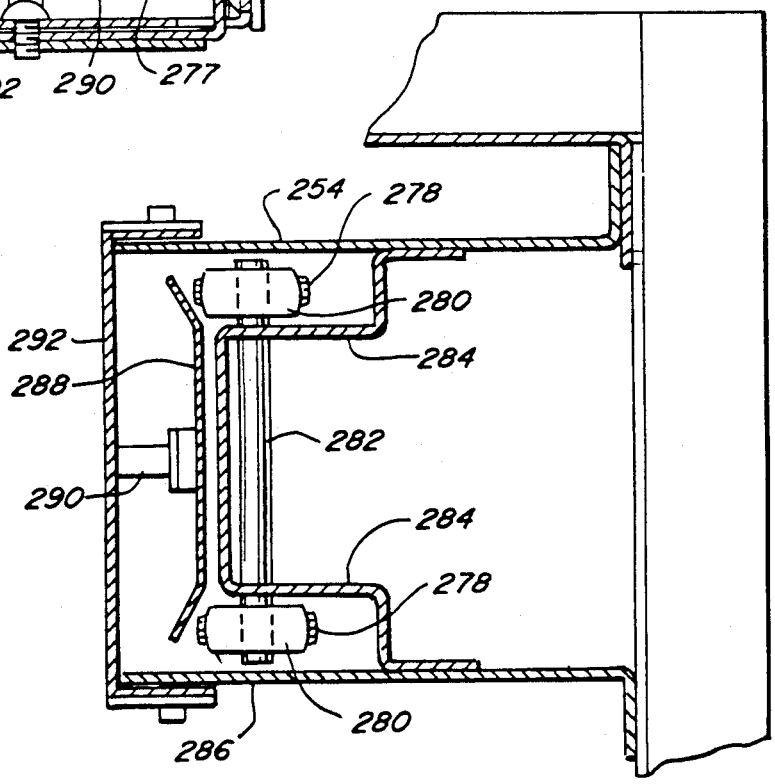

USER SELECT BUTTONS
BILL TRANSPORTER
348
236
344
346
INPUT PORTS
OUTPUT PORTS
336
340
342
314
312
DECODE LOGIC
338
SAFE RAM
MEMORY LATCH
MEMORY DECODER
316
308
310
306
ROM
RAM
304
CLK
RESET CIRCUIT
326
CPU
216
DUART 1
DUART 2
P/A
VIA
RTC
318
320
322
324
INTERRUPT PRIORITY
CLK
328
321
332
334
DTRACK GENERATOR
330
EXTERNAL COM. INTERFACE
BILL VALIDATOR
ALPHA-NUMERIC DISPLAY
323
325
230
228

BILL VALIDATION AND CHANGE SYSTEM FOR A SLOT MACHINE

RELATED APPLICATION

This application is a continuation of application Ser. No. 07/118,090 filed Nov. 6, 1987 now abandoned which was a continuation-in-part of Ser. No. 06/829,298, filed Feb. 12, 1986 now abandoned.

TECHNICAL FIELD

The invention relates to the field of coin operated gaming machines and in particular to gaming machines that pay out coins or tokens from an internal coin store for winning plays.

BACKGROUND OF THE INVENTION

Typical gaming devices, such as a slot machine, accept coins or tokens of one denomination to play a game, the accepted coins being stored in a coin hopper contained in the machine. Winning game plays are determined randomly by the slot machine which pays out to the winners coins from the coin hopper.

Because typical slot machines accept coins of only a single denomination, a player must have that denomination of coin to play the slot machine game. Casinos having slot machines typically employ personnel to provide change for bills to players at the slot machines so that the players do not have to leave the machines if they wish to continue playing but do not have the correct denomination of coin. However, in large and busy casinos, slot machine players may encounter long waits for such change personnel to come by.

SUMMARY OF THE INVENTION

It is therefore an object of the invention to provide a slot machine bill validation and change system integral with the slot machine so that the player need not leave the slot machine when change is needed. Further, the system can accept bills of a plurality of denominations and pay out change for the bills only in coins of the denomination accepted by the slot machine to enable players to play the maximum number of games for their bills without requiring additional change to be made.

A further object of the invention is to provide a slot machine bill validation and change system including an input device which accepts coins input by a player to play a slot machine game. The coins are stored in a coin hopper which is controlled to payout coins to winners of the slot machine game and to make change for bills. Bills input to the system are received by a bill input device which determines the validity and denomination of an input bill and which is controllable to accept or reject bills. The slot machine bill validation and change system includes a master processor which determines winning game plays for the slot machine and whether change for a bill input to the system should be made; and which further controls the coin hopper to payout coins to winners and to make change for a bill. The master processor is coupled to a slave processor for communication therebetween. The slave processor is coupled to the bill input device for determining, in conjunction therewith, the denomination and validity of an input bill for communication to the master processor. The slave processor also controls the bill input device to accept bills for which change should be made as determined by the master processor and to reject invalid bills or valid bills for which change should not be made.

The master processor further monitors the number of coins in the coin hopper to prevent the acceptance of a bill by the input device when the coin hopper has less than a predetermined minimum number of coins. The master processor also monitors the coin input device to prevent change from being made after a coin has been accepted or when a game is in progress.

An additional object of the invention is to permit change to be made for bills of a number of different denominations for the convenience of a slot machine player so that the player does not have to leave the machine or wait for casino personnel when change is needed. To further convenience the player, change is made only in coins having the same denomination as coins which are accepted by the slot machine to play a game.

Another object of the invention is to provide a gaming machine bill validation system which is integrated into the housing of the machine. Also included in the invention is a bill transport mechanism that is effective to transport accepted bills from a bill validator to a cash box.

BRIEF DESCRIPTION OF THE DRAWINGS

FIG. 1 is a perspective view of a slot machine and bill validation unit according to a first embodiment of the present invention;

FIG. 2 is an enlarged view of the bill validation unit of FIG. 1, a portion of which is cut away to show the passage of an accepted bill to a cash box contained in the unit;

FIG. 7 is a cross section taken along lines 7—7 of FIG. 6;

FIG. 8 is a cross section taken along lines 8—8 of FIG. 6;

FIG. 9 is a cross section taken along lines 9—9 of FIG. 6;

DETAILED DESCRIPTION OF THE INVENTION

Figure 3:
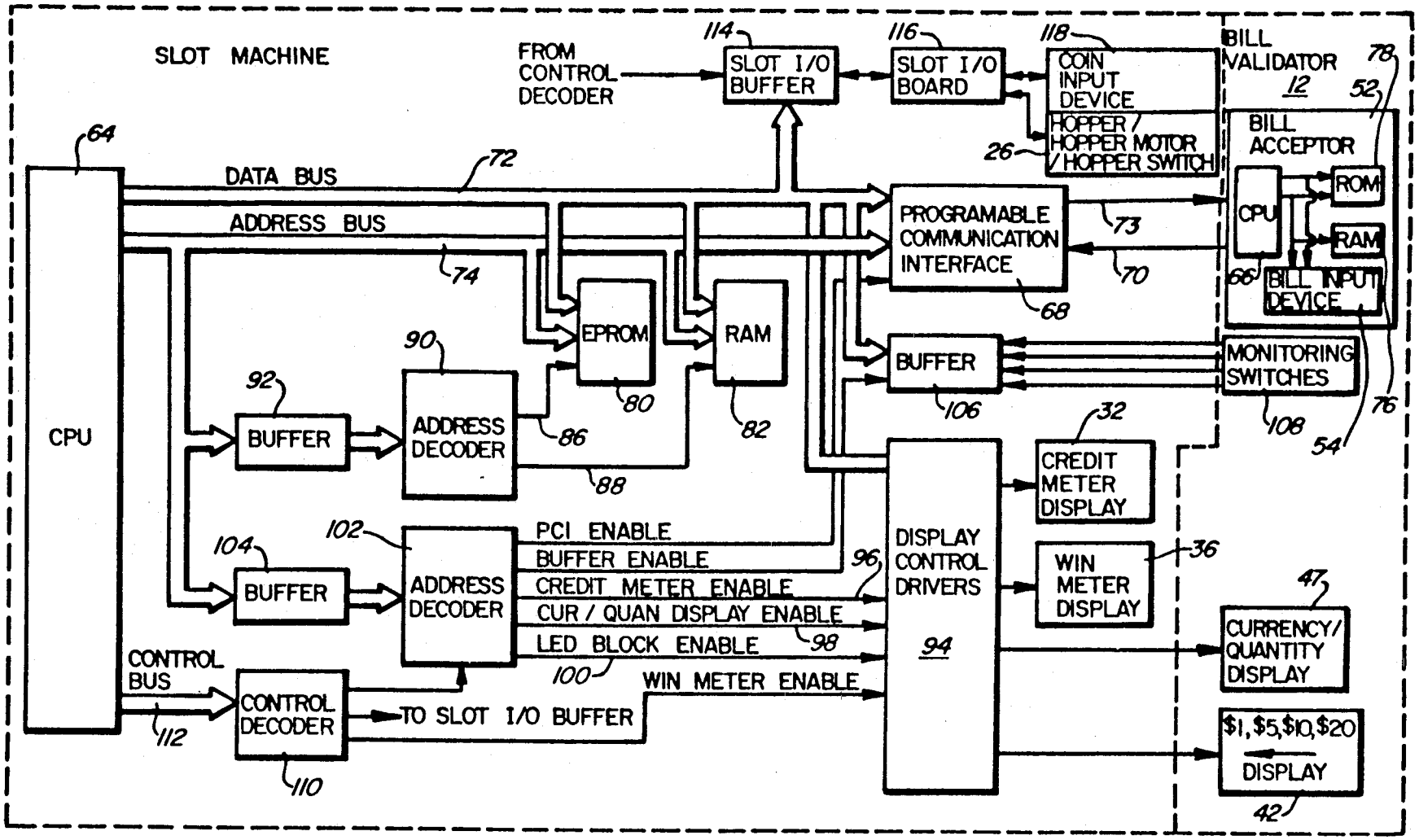
FIG. 3 is a block diagram illustrating the slot machine and bill validation unit of the first embodiment as illustrated in FIG. 1.

The slot machine bill validation and change system according to a first embodiment of the present invention, as shown in FIGS. 1-3, includes a microprocessor based slot machine 10, to the housing of which is attached a bill validator unit 12. The slot machine includes three symbol bearing reels 14, 16 and 18 or a video display representation thereof. To operate the device, a player inserts one or more coins or tokens into a slot 20 and pulls a handle 22. Pulling the handle will start the symbol bearing reels rotating. After a certain length of time, the reels will sequentially come to a stop and a certain combination of symbols will be displayed on the reels. If a combination of symbols matches one of a predefined combination, the slot machine's microprocessor or CPU 64, see FIG. 3, determines that a win has occurred and controls the dispensing of a specified number of coins from a coin hopper 26 through a payout chute 24.

To enable a player to store his winnings in the machine 10 while he continues to play, a credit button 30 is provided. If a player uses the credit button to store his winnings, the amount stored is displayed on a credit meter 32. When the player wishes to collect money stored by the machine as depicted on the credit meter 32, he depresses a collect button 34 and the money is paid out from the hopper 26 through the payout chute 24. A win meter 36 displays the number of coins played and amount of money won for the most recent winner.

As shown in FIGS. 1 and 2, the bill validator unit 12 includes a slot 40 through which bills are inserted when change is desired. The unit 12 includes a display 42 comprised of LED blocks which are controlled by the processor 64 of the slot machine 10.

The LED block display 42 includes a bill denomination display 43 which depicts the various denominations of bills for which change can be made at a particular instant. The LED block display 42 also includes an arrow display 44 showing that change for a bill inserted into slot 40 will be paid out from the slot machine 10 to the left of the bill validator unit 12. The bill validator 12 also includes a second display 47 comprised of five LED, seven segment number displays, two of which depict the digits of a currency display 46 and three of which depict the digits of a quantity display 48. The currency display 46 shows the denomination of a bill input to the slot 40 whereas the quantity display starts at zero and is incremented by one as each coin is paid out to depict the total number of coins paid out from the coin hopper 26 as the coins are being output through the chute 24.

The validator unit 12 includes a microprocessor based bill acceptor 52. The bill acceptor 52, as shown in FIG. 3, has a bill input device 54 for determining, in conjunction with the bill acceptor's processor 66, the validity and denomination of a bill inserted through the slot 40. The bill input device may include rollers or the like which engage a bill as it is inserted through the slot 40. The rollers are controlled by the bill acceptor's processor 66 to pass a bill 55 to a cash box 56 located directly below the bill acceptor 52 when the bill validator 12 accepts the bill, the rollers being controlled to reciprocate the bill out through the slot 40 when the validator 12 rejects the bill.

The bill validator unit 12 is a secure unit which requires a key to be inserted into a lock 58 to open a door 61 leading to the cash box 56. A second lock 60 is provided to secure the lid 62 of the validator unit 12. When opened, the lid 62 provides access to the bill accepter 52. Monitoring switches 108, as shown in FIG. 3, sense the presence of the bill acceptor 52 and the cash box 56. The switches 108 also signal the opening of the door 61 and lid 62 to alert the slot machine's processor 64.

The slot machine bill validation and change system, as shown in FIG. 3, includes a master computer or central processing unit, CPU 64 contained in the housing of the slot machine 10 and a slave computer or CPU 66 contained in the bill acceptor 52. The CPU 66 of the bill acceptor 52 communicates with the CPU 64 through a programmable communication interface 68. The programmable communication interface 68 converts serial data received from the bill acceptor 52 on a line 70 to parallel data output on a data bus 72 coupled to the CPU 64. The programmable communication interface also converts parallel data received from the data bus 72 to serial data output to the bill acceptor 52 on a line 73.

The CPU 66 of the bill acceptor 52 is coupled to a RAM 76 and a ROM 78 through appropriate address and data buses, the RAM and ROM respectively storing data and software for controlling the operation of the bill acceptor 52. Similarly, the CPU 64 is coupled to an EPROM 80 through the data bus 72 and an address bus 74, the EPROM 80 storing software which determines how the slot machine game is played and software needed by the slot machine 10 for communication with the bill validator 12. The slot machine's CPU 64 is also coupled to a RAM 82 through the data bus 72 and address bus 74. The RAM 82 stores data used for bookkeeping purposes and data representing various parameters generated for the slot machine game. In particular, the RAM 82 stores data which represents among other things, the quantity of change vended, i.e. the number of coins paid out from the coin hopper 26 to make change for an accepted bill; the total number of coins contained in the hopper 26; and the total number of coins paid out by the slot machine 10 to provide change and winning payouts. The RAM 82 also includes a storage location which forms a payout counter as discussed in detail below with reference to FIGS. 4A and 4B. The EPROM 80 and the RAM 82 are enabled by outputs on respective lines 86 and 88 from an address decoder 90. The address decoder 90 decodes addresses output from the CPU 64 on the address bus 74, the addresses being coupled to the decoder through a buffer 92.

The display meters for the slot machine and bill validator, including the credit meter 32, the win meter 36, the currency/quantity display 47 and the bill denomination and arrow display 42, are driven by a number of display control drivers 94. The display control drivers 94 for the credit meter 32, currency/quantity display 47 and bill denomination and arrow display 42 are enabled by outputs on respective lines 96, 98 and 100 from an address decoder 102. The address decoder receives addresses from the bus 74 through a buffer 104 and decodes the buffered addresses to enable a particular one of the display control drivers 94, the programmable communication interface 68 or a buffer 106 coupled to the monitoring switches 108 of the bill validator unit 12.

The slot machine 10 further includes a control decoder 110 which is responsive to control signals from the CPU 64 on bus 112 to enable either the display control driver 94 for the win meter display 36 or to enable a slot machine input/output buffer 114. The slot machine input/ output buffer 114 couples data to and from the data bus 72 and a slot machine input/output board 116 which is coupled to the coin hopper 26 and a coin input device 118. The coin input device 118 is coupled to the coin slot 20 to receive coins of one denomination which are input through the slot 20. The coin input device 118 determines the validity of coins and accepts or rejects the coins, the device 118 being coupled to the coin hopper 26 to store valid and accepted coins therein. The device 118 further includes a switch which is actuated in response to each accepted coin as the coin passes to the coin hopper for storage as discussed below. Each time the coin input switch is actuated, a signal is communicated to the data bus 72 from the input device 118 so that the CPU 64 may update the RAM 82.

The hopper 26 is controlled by the CPU 64 through the slot input/output buffer 114 and the slot input/output board 116 to payout coins through the payout chute 24 for winning game plays. The hopper 26 includes a switch which is actuated each time a coin is paid out from the hopper. Each time the hopper switch is actuated, a signal is communicated to the data bus 72 from the hopper 26 indicating the payout of a coin so that the CPU 64 may update the RAM 82 for winning game payouts and change payouts as discussed below.

Figure 4A:
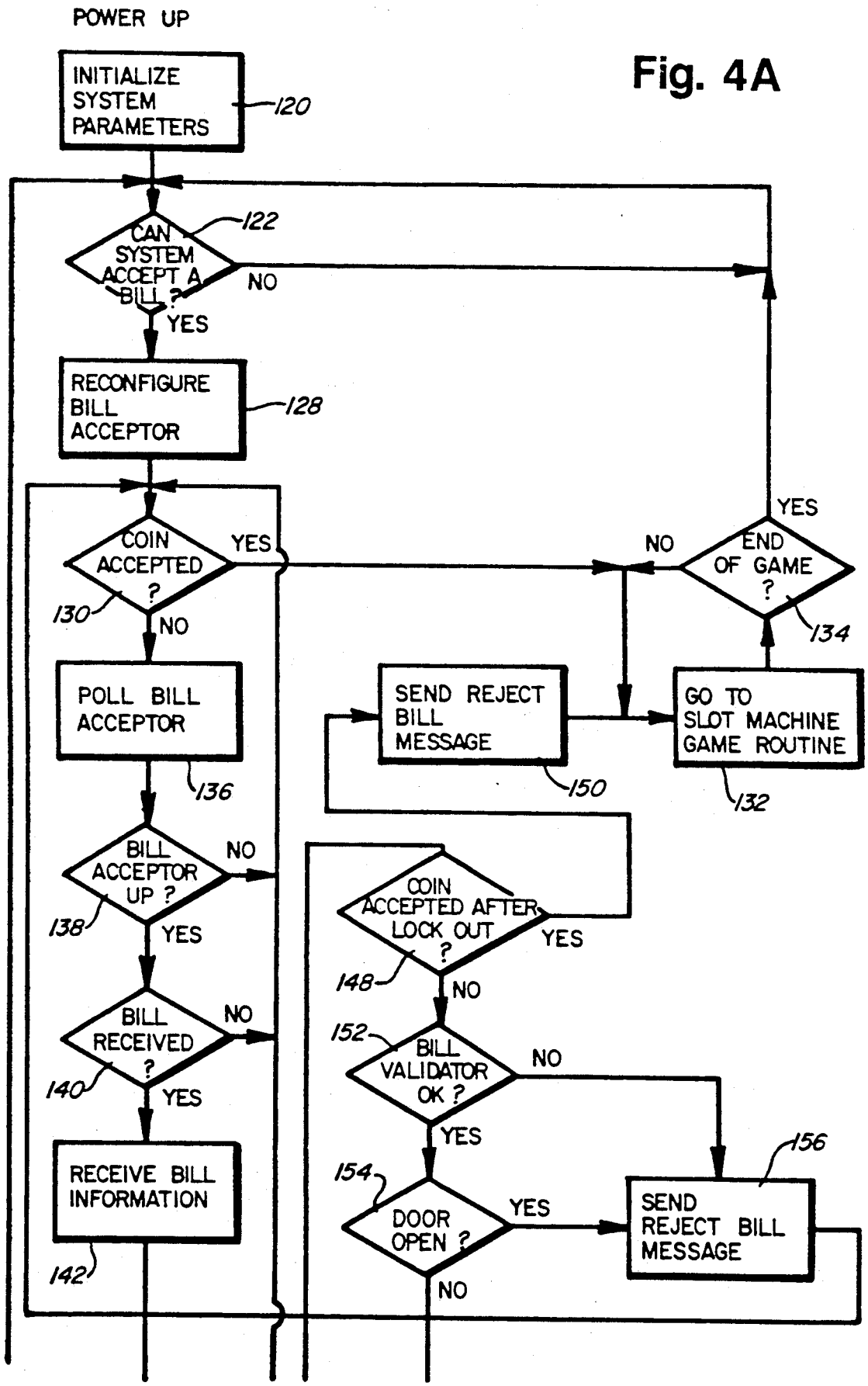
FIGS. 4A and 4B form a flowchart illustrating the change control provided by the slot machine's processor shown in FIG. 3.
Figure 4B:
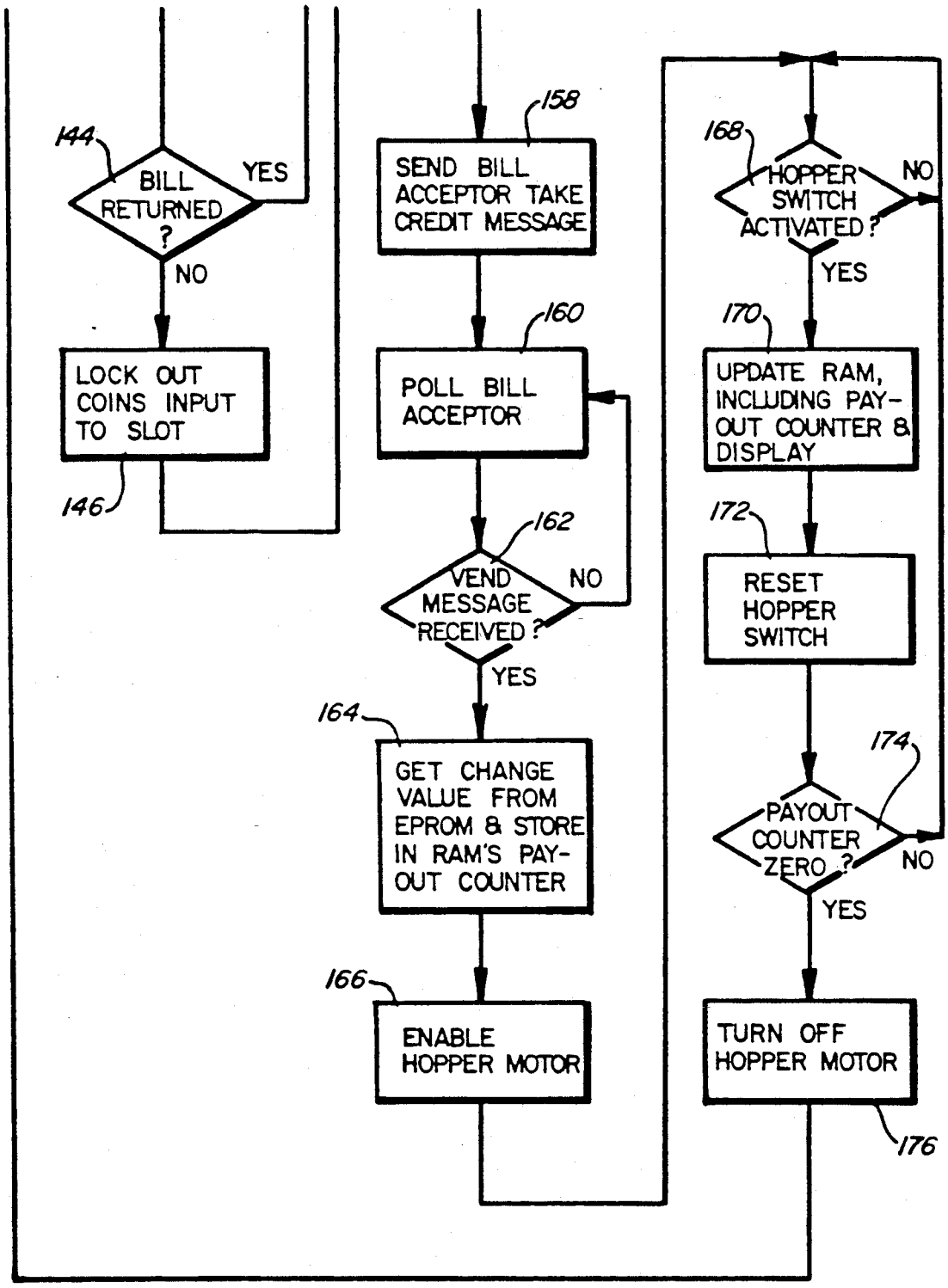

The operation of the bill validation and change system will now be described with reference to the flowchart of FIGS. 4A and 4B. Upon power up of the system, the system parameters are initialized at block 120. These parameters include the hopper cutoff values for each bill denomination which can be accepted by the bill validator unit 12. The hopper cutoff values represent the least number of coins needed in the hopper 26 to allow change to be dispensed for a particular bill denomination. For the bill validator unit 12 illustrated in FIGS. 1 and 2, hopper cutoff values are set for bills of the following denominations: $1.00, $5.00, $10.00 and $20.00.

After the system parameters are initialized, at block 122, the CPU 64 of the slot machine determines whether the system can accept a bill. The system cannot accept a bill if any one of the following conditions exist: (1) a game is currently being played such that the handle 22 of the slot machine has been pulled; (2) a coin has been inserted so that a game is about to be played; (3) a door on either the slot machine 10 or the bill validator unit 12 is open; (4) the slot machine 10 is locked up on a win; (5) the number of coins in the hopper is less than the cutoff value for the smallest bill denomination which may be accepted by the bill validator unit 12; (6) the system is out of order; and (7) the slot machine is in a tilt. If one or more of these conditions exists, the CPU 64 will prevent the acceptance of a bill by the validator 12. Machine lock up (4) normally occurs when the amount of a win, such as a jackpot, is greater than the number of coins in the hopper. If any one of conditions (3) and (5)–(7) exists, the CPU 64 will further control the coin input device 118 through the slot I/O buffer 114 and the slot I/O board 116 to reject any coins input to the slot machine 10 and will instruct the bill acceptor 52 through the programmable communication interface 68 to clear the bill denomination display 43 so that the LED blocks forming each of the bill denominations are not lit. The CPU 64 then returns to block 122.

If the system can accept a bill as determined at block 122, the CPU 64 reconfigures the bill acceptor 52 at block 128 by instructing the bill acceptor as to what bill denominations are acceptable. More specifically, the CPU 64 checks the number of coins presently stored in the coin hopper 26 and compares this number to the hopper cutoff value for each bill denomination. If the number of coins in the hopper is greater than or equal to the cutoff value for a particular denomination, the CPU 64 instructs the bill acceptor, at block 128, that that particular bill denomination is acceptable. Next, at block 130, the CPU 64 determines whether a coin has been accepted by the coin input device 118. If a coin has been accepted, the CPU 64 executes a slot machine game routine at block 132. At the end of a slot machine game as determined at block 134, the CPU 64 returns to block 122 to determine whether the system can now accept a bill. If it was determined at block 130 that a coin was not accepted, the CPU 64 polls the bill acceptor 52 at block 136 and at block 138 determines whether the bill acceptor 52 is operating. If the bill acceptor is up and operating as determined at block 138, the CPU 64 determines, at block 140, whether a bill has been received by the bill acceptor 52.

When the bill acceptor 52 receives a bill input through slot 64, the bill acceptor responds to a poll from the CPU 64 with a busy message. At this time, the bill acceptor 52 checks the validity and denomination of the received bill to determine if the bill is one which may be accepted. After determining the validity of the bill and whether the bill has an acceptable denomination as dictated by the CPU 64, the bill acceptor 52, in response to a poll by the CPU 64, transmits bill information to the slot machine's CPU 64. At block 142, the CPU 64 receives the bill information from the bill acceptor 52, the information including either a "note returned" message if the bill is invalid or has a denomination which cannot be accepted, or the denomination of an acceptable bill being held by the bill acceptor 52.

If a valid bill has been received by the bill acceptor 52 and the bill has not been returned as determined by the CPU 64 at block 144, the CPU 64, at block 146 instructs the coin input device 118 to lock out coins input to the slot machine 10. The coin input device 118 includes a device for detecting the validity of a coin, the detecting device rejecting any coin determined to be bad and also rejecting coins if instructed to do so by the CPU 64. The coin validity detecting device allows coins to pass to the coin hopper if a coin is determined to be valid and may be accepted. Downstream of the coin validity detecting device, is a switch which senses the presence of an accepted coin as it passes to the coin hopper. The CPU 64 is responsive to the actuation of the switch to update values in the RAM 82 which represent the present number of coins in the coin hopper 26. The CPU 64 is also responsive to actuation of the switch to determine at block 148 whether a coin has been accepted after the lock out command was issued to the coin input device 118. If a coin was accepted after lockout, the CPU 64, at block 150 sends a "reject bill" message to the bill acceptor 52 and at block 132 executes the slot machine game routine. If a coin has not been accepted after lockout as determined at block 148, the CPU 64 checks the monitoring switches 108 to determine at block 152 whether the bill acceptor 52 and the cash box 56 are in place and at block 154 whether any doors are open. If the monitoring switches 108 indicate that either the bill acceptor 52 or cash box 56 has been removed or that a door is open, the CPU 64 sends a reject bill message to the bill acceptor 52 at a block 156.

If the monitoring switches 108 indicate that the system is alright, at block 158, the CPU 64 sends to the bill acceptor 52 a "take credit" message. The bill acceptor 52 responds to a "take credit" message by accepting the received bill and passing the bill to the cash box 56. At block 160, the CPU 64 again polls the bill acceptor 52 for a vend message which indicates that a bill has passed to the cash box 56. When the vend message is received from the bill acceptor 52 as determined by the CPU 64 at block 162, the CPU 64, at block 164, retrieves from a table stored in the EPROM 80 the change value for the denomination of the bill accepted and stores the change value in the payout counter register of the RAM 82. The change value represents the number of coins required to make change for the accepted bill. After initializing the payout counter at block 164, the CPU 64, at block 166, enables the hopper motor to cause the hopper 26 to release a coin through the payout chute 24. The hopper 26 includes a switch, as discussed above, which detects each coin paid out from the hopper. The CPU 64 monitors the hopper switch to determine whether it has been actuated or not. When the hopper switch has been actuated, indicating that a coin has been paid out from the hopper, as determined at block 168, the CPU 64, at block 170, updates the RAM 82 and the quantity display 48. More specifically, at block 170, the CPU 64 decrements the payout counter by one; and increments the change vended and total slot machine output values stored in the RAM 82. The CPU 64 further increments the RAM location corresponding to the quantity display 48 to cause the display to show the number of coins presently paid out. The CPU 64, at block 172, resets the hopper switch and at block 174 determines whether the payout counter has reached zero. If the payout counter has not reached zero, the CPU 64 waits for the hopper switch to be actuated again to update the RAM 82 and quantity display 48 as the next coin is paid out. When the payout counter reaches zero, as determined at block 174, the CPU 64 at block 176 turns off the hopper motor and returns to block 122.

A slot machine bill validation and change system according to a second embodiment of the present invention, as shown in FIGS. 5-10, includes a bill validator integral with a microprocessor based slot machine 200 having a housing 202. The housing 202 includes a top section 204 and a lower section 206. Access to controls for the slot machine 200 is provided with a front door 207 hingedly mounted to the housing lower section 206. The housing top section 204 houses, for example, three symbol bearing reels 208 or a video display representation thereof. To operate the device, a player inserts one or more coins or tokens into a coin slot 210 and pulls a handle 212 or depresses a Spin button 214. Pulling the handle 212 or depressing the button 214 starts the symbol bearing reels 208 rotating. After a certain length of time, the reels 208 sequentially stop and a certain combination of symbols is displayed on the reels 208. If the combination of symbols matches one of a predefined combination, then the slot machine's microprocessor, or CPU, 216, see FIG. 10, determines that a win has occurred and stores a number representing the player's winnings in a credit register as discussed more specifically below.

Figure 6:
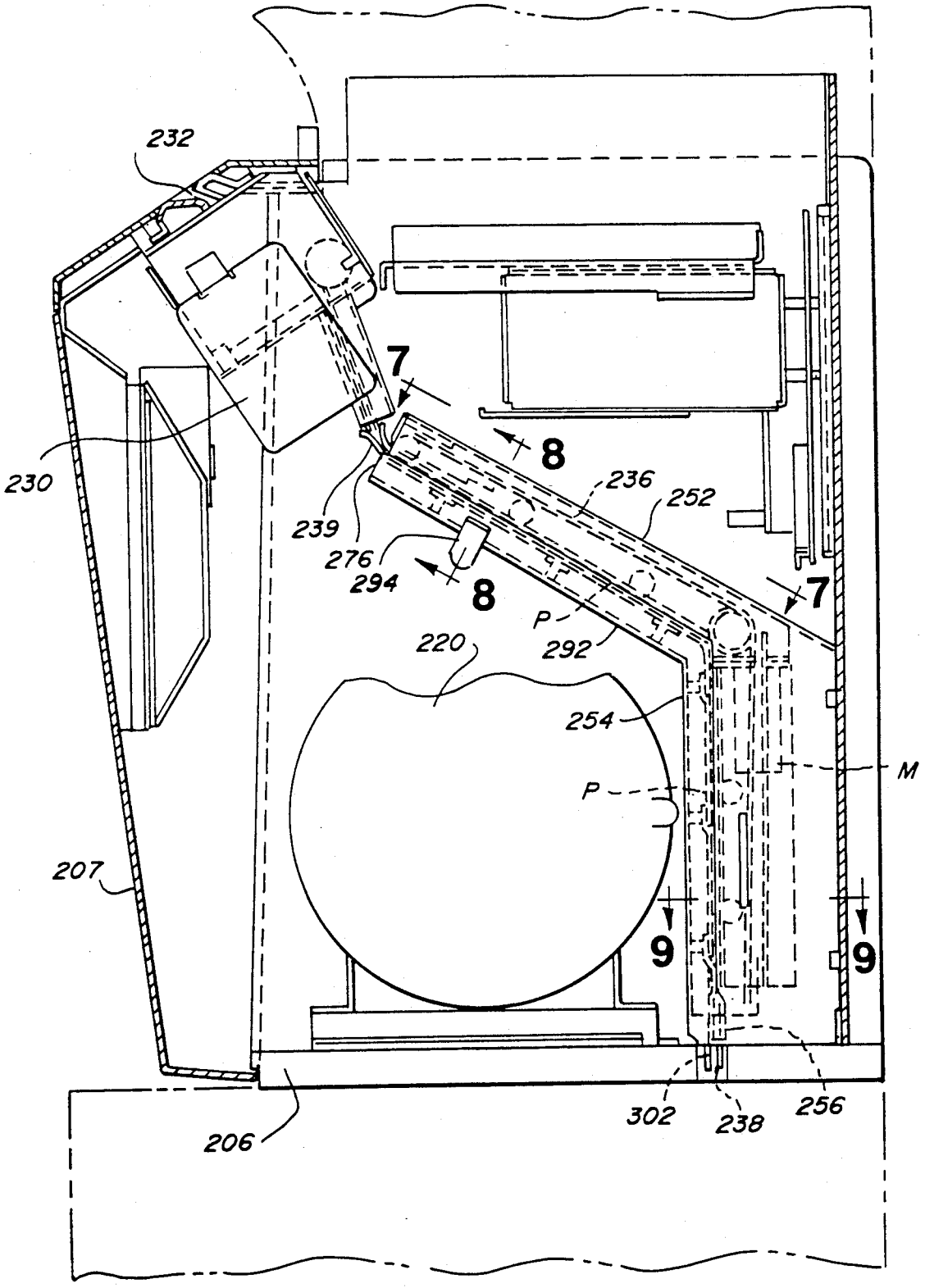
FIG. 6 is a side view in cross section of the slot machine of FIG. 5.

After a player has won a game, resulting in winnings being stored in the credit register by the CPU 216, the player may depress a Collect button 218 mounted on the door 207 causing the specified number of coins to be paid out from a coin hopper 220, see FIG. 6, through a payout chute 222. Alternatively, a player may utilize stored credits in order to play a subsequent game. Particularly, by depressing a Bet Play Credit button 224, the player may utilize a single credit in order to play a game, wherein a single credit represents the equivalent of a single coin. Additionally, where a gaming device permits a player to insert multiple coins to increase the potential winnings in a game, a Bet Max Play button 226 may be depressed to utilize a number of credits equivalent to the maximum number of coins playable in a single game. For example, a slot machine may allow up to three coins, and therefore three credits, to be used to play a single game.

The slot machine 200 includes a multi-character alphanumeric display 228 mounted to the door 207. The alphanumeric display 228 acts as a message center and is operable to provide status and instructional information during game play; indicate credits available and credits being played; provide machine operation information to an operator thereof; and indicate information relative to the bill validator, discussed more specifically below.

Referring also to FIG. 6, a bill validator 230 is mounted to the front door 207 and has an inlet slot 232 which faces outwardly through an opening in the door 207 for receiving currency of various denominations. The particular bill validator disclosed herein is a Mars Electronics High Order Bill Currency Validator including an electronic interface for communicating with external control systems. However, alternative bill validators could be used in conjunction with the slot machine of the present invention, as is obvious to those skilled in the art. The bill validator includes circuitry (not shown) which determines both the denomination of the bill and the validity thereof and communicates such information to the CPU 216 as discussed below. After a bill has been accepted, it exits through an outlet slot 234 which is in communication with a bill transporter or conveyor 236. The bill transporter 236 transports the bill away from the validator 230 rearwardly and downwardly through the housing lower section 206 until the bill exits a slot 238 in the bottom thereof.

Figure 5:
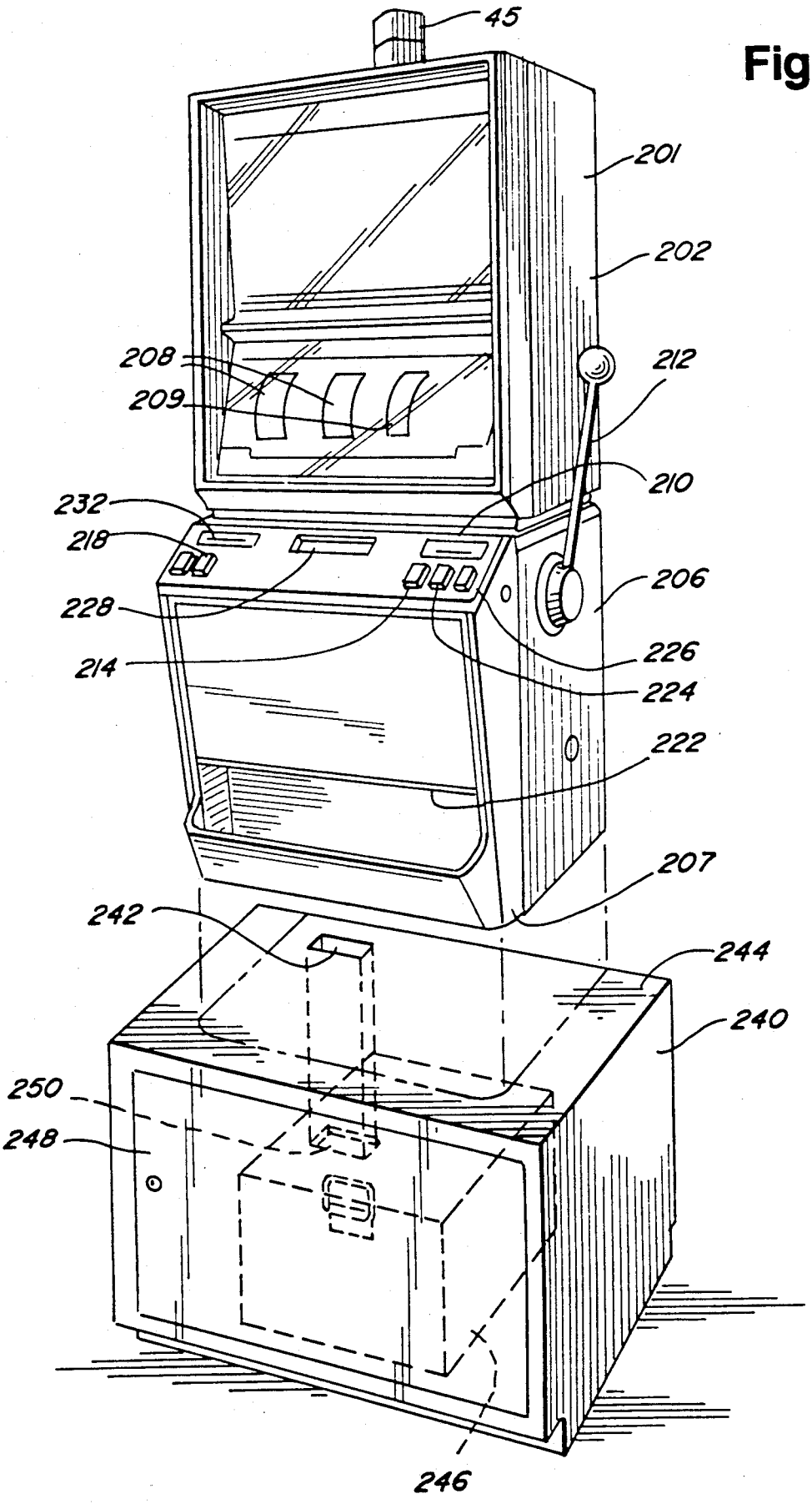
FIG. 5 is a perspective view of an integral slot machine and bill validation unit according to a second embodiment of the present invention.

Referring particularly to FIG. 5, the slot machine 200 rests on a stand 240 having an opening 242 through a top wall 244 thereof. A cash box 246 is installed in the stand 240 behind a locked door 248. The cash box 246 includes an aperture 250. With the slot machine 200 properly positioned on the stand 240 and the cash box 246 in place, the slot 238 is in communication with the stand opening 242 and the cash box opening 250. Accordingly, once an acceptable bill has passed through the transporter 236, it exits through the bottom opening 238 of the slot machine 200 into the cash box 246 where it is stored until the operator removes the bill therefrom.

Referring also to FIGS. 7-9, the bill transporter 236 includes a first or diagonally oriented transporter section 252 which extends to a second or vertically oriented transporter section 254. The two sections 252 and 254 collectively define a bill passageway P extending therethrough.

A motor M housed in the second section 254 includes a motor output shaft 256 rotatably secured to a worm 258. The worm 258 engages and drives a worm gear 260 secured to a drive shaft 262. The drive shaft 262 rotates a pair of inner drive pulleys 264 and a pair of outer drive pulleys 266. Each of the inner drive pulleys 264 and an opposite pair of idler pulleys 270 carries a respective drive belt 268. The idler pulleys 270 are mounted on an idler shaft 272 journaled in axial supports 274 at an inlet end 276 of the bill transporter first section 252. An elongated carrier plate 277 is spaced from the belts 268 to define the portion of the passageway P through the first section 252.

A second pair of drive belts 278 are carried by the outer pair of drive pulleys 266 and opposite idler pulleys 280 fixed to a lower shaft 282 journaled in axial supports 284 at an outlet end 286 of the transporter second section 254. The second section 254 also includes an elongated carrier plate 288 for carrying a bill and in conjunction with the drive belts 278 defines the portion of the passageway P through the second section 254. The belts 268 and 278 all being rotatable about the drive shaft 262 provide a smooth transition of the passageway P at a position PI where the first and second sections 252 and 254, respectively, meet.

When the motor M is energized causing the worm 258 to rotate, the worm gear 260 is driven causing the drive shaft 262 and its associated drive pulleys 264 and 266 to rotate thereby, rotating the drive belts 268 and 278. If a bill is inserted in the passageway P with the motor M energized, then the respective carrier plates 277 and 288 hold the bill in engagement with the belts 268 and 278, respectively, to convey the bill from the inlet end 276 via the passageway P and out the housing slot 238 adjacent the transporter outlet end 286.

The upper and lower carrier plates 277 and 288, respectively, are linked using offsets 290 to a door 292 which also defines a forward wall for the transporter 236. The door 292 includes a slidable latch 294 connected to tabs 296 received in apertures 298 of transporter side walls 300 for holding the door in place. When the latch 294 is moved away from the transporter 236, as indicated by the arrow, the tabs 296 exit the apertures 298 enabling the door 292 to be pivoted downwardly. Due to the linkage between the door 292 and the carrier plates 277 and 288, movement of the door 292 causes movement of the plates 277 and 288 away from the respective drive belts 268 and 278, respectively. Accordingly, if a bill becomes jammed in the passageway P, the door 292 can be opened to provide access thereto for removal of the bill to unjam the transporter 236.

An optical sensor 302 is provided at the transporter outlet end 286 and extends into the outlet slot 238 to sense when a bill passes thereby. The sensor is used to indicate the presence or absence of a bill in the slot 238 and can be used to indicate the passing of the trailing edge of a bill to indicate to CPU 216 that a bill has exited the transporter 236 and thus entered the cash box 250 in the stand 240.

Figure 10:
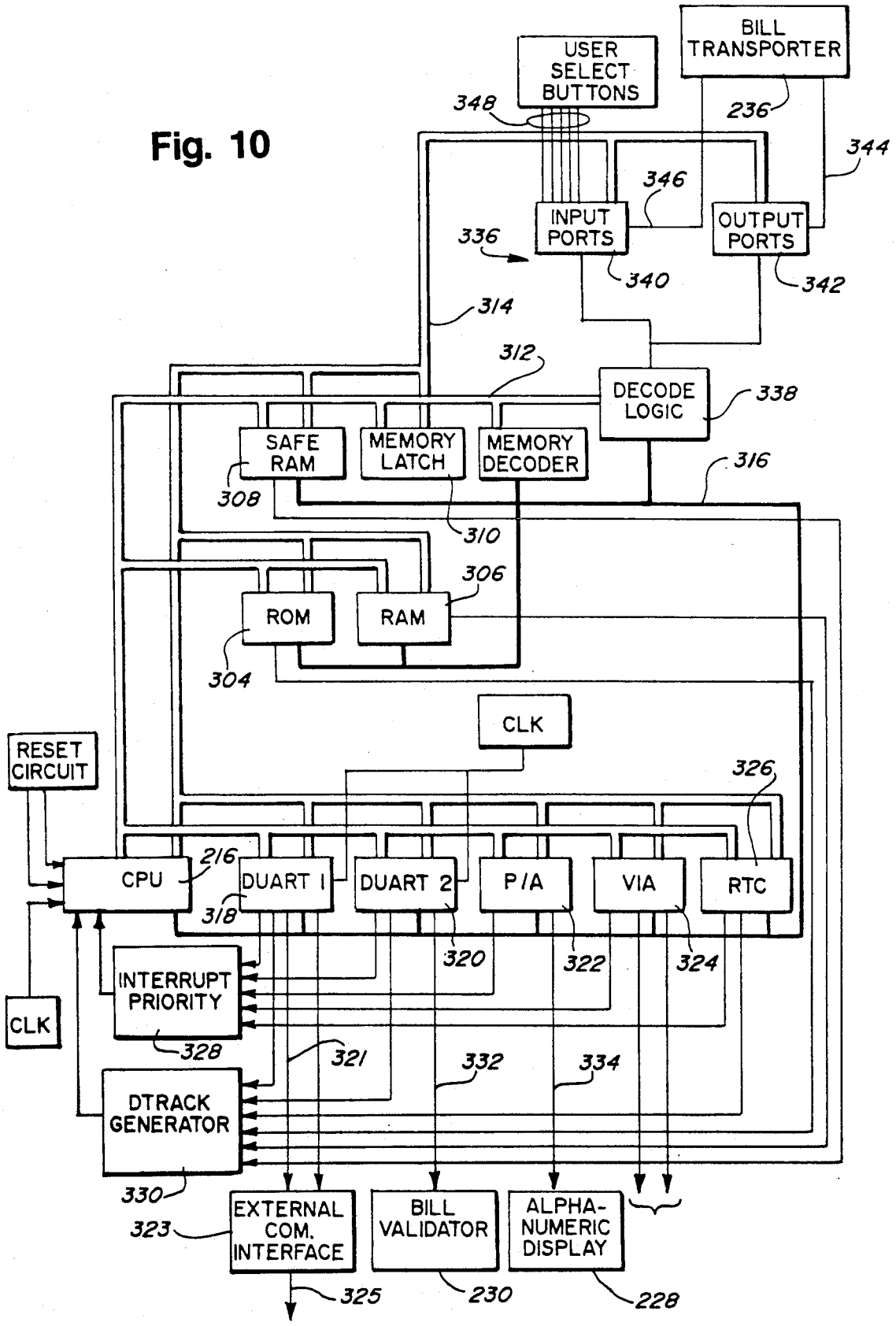
FIG. 10 is a block diagram illustrating the slot machine and bill validation unit of the second embodiment as illustrated in FIG. 5.

The slot machine change system, as shown in FIG. 10, includes the CPU 216 housed in the slot machine lower section 206. The CPU 216 is coupled to a ROM 304, a RAM 306, a safe RAM 308 and a memory latch 310 through appropriate address and data buses 312 and 314, respectively. The RAM 306 and the ROM 304 respectively store data and software for controlling the operation of the slot machine 200. Similarly, the CPU 216 is coupled through the address and data buses 312 and 314, respectively, and a control bus 316 to blocks representing first and second dual universal asynchronous receiver transmitters (DUARTs), 318 and 320, respectively, a parallel interface adaptor (PIA) 322, a versatile interface adaptor (VIA) 324 and a real time clock (RTC) 326. Each of the blocks 318-326 is also coupled to an interrupt priority circuit 328 and to a DTACK generator 330 which are in turn coupled to the CPU 216. The interrupt priority circuit 328 sends an interrupt signal to the CPU 216 when requested to do so by any of the associated blocks. The DTACK generator 330 provides a data transfer acknowledge signal to the CPU 216 indicating the completion of data transfer.

The DUART blocks 318 and 320 are programmable serial communication chips which are used to interface to external devices. The bill validator 230 is connected via a line 332 to the DUART 2 block 320 for providing communication therebetween. It should be appreciated that the line 332 represents more than one signal, as is discussed more specifically below. The DUART 1 block 318 is connected by a line 321 to an external communications interface board 323 within the slot machine 20 that is connected in turn to an external data system (not shown) by a line 325.

The PIA block 322 interfaces parallel I/O ports with the alphanumeric display 228, shown in FIG. 5. The PIA 322 provides drive signals over a line 334 to drive the display 228. The VIA block 324 also includes parallel I/O ports and is coupled to other slot machine devices that can detect for example when the slot machine 200 is in a tilt condition.

I/O circuitry 336 includes an address decode logic circuit 338 coupled to the address bus 312 and the control bus 316 and to appropriate input ports 340 and output ports 342. The data bus 314 is also coupled to the input and output ports 340 and 342, respectively. One channel of the output ports 342 is connected over a line 344 to the bill transporter 236 to drive the motor M, shown in FIG. 6. One of the channels of input ports 340 is connected over a line 346 to the bill transporter 236 to receive a signal from the outlet sensor 302. Appropriate channels of the input ports 340 are also coupled to user select buttons 214, 218, 224 and 226, discussed above relative to FIG. 5, as represented by lines 348. Accordingly, the input ports are operable to read the status of the input devices coupled thereto when instructed to do so by the decode logic circuit 338 causing the status information to be sent to the CPU 216 over the data bus 314. Similarly, when instructed to do so by the decode logic circuit 338, the output port 342 reads data received from the data bus 314 to cause the motor M to start or stop as necessary.

The operation of the bill validator 230 is discussed with reference to the timing diagram illustrated in FIG. 11. The bill validator 230 receives an $\overline{\text{ACCEPT ENABLE}}$ signal and a $\overline{\text{SEND}}$ signal, represented by timing diagrams A and C, respectively, from the CPU 216 via the DUART 2 block 320 over the line 332. Similarly, the bill validator 230 transmits an $\overline{\text{INTERRUPT}}$ signal and a $\overline{\text{DATA}}$ signal over the line 332, represented by timing diagrams B and D, respectively, to the CPU 216 also via the DUART 2 block 320.

Figure 11:
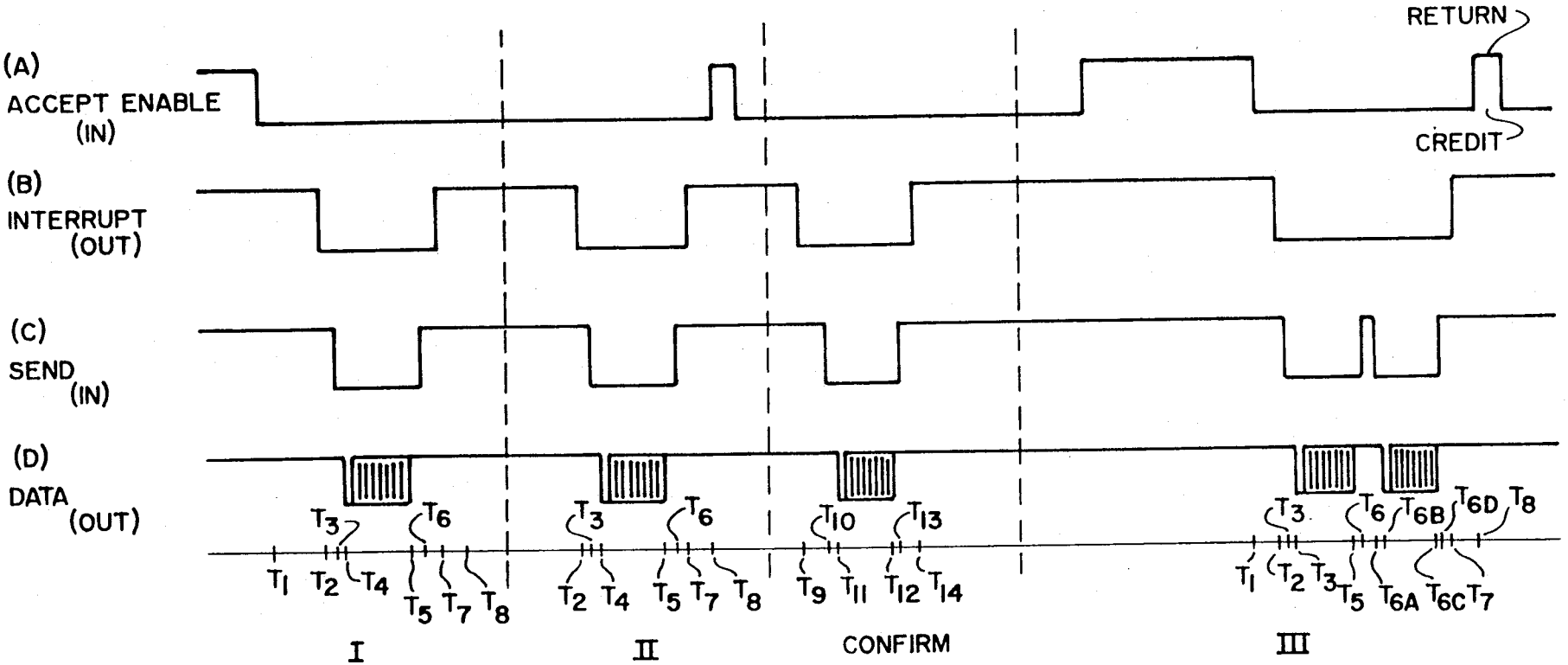
FIG. 11 is a timing diagram of the control operation of the bill validator of FIG. 5.

The operation of the bill validator is illustrated by way of three Examples I, II and III in FIG. 11. Particularly, Example I illustrates the receipt and crediting of an acceptable bill. When the $\overline{\text{ACCEPT ENABLE}}$ signal is in a logic 1 state, the bill validator 230 is precluded by the CPU 216 from accepting any bills. Under these circumstances, any bill inserted in the validator slot 232 is immediately returned. When the signal $\overline{\text{ACCEPT ENABLE}}$ goes to logic 0 at time $T_1$, the bill validator 230 is enabled for accepting bills. If the bill validator 230 is enabled and a bill is received therein, the bill validator 230 using its own circuitry, not shown, determines the validity and denomination of the bill, as is well-known in the art. If the bill validator 230 determines that the bill is acceptable, then the $\overline{\text{INTERRUPT}}$ signal to the CPU 216 goes from a logic 1 to a logic 0 state at time $T_2$ to indicate to the CPU 216 that a valid bill has been received. Once the bill validator 230 receives a logic 0 $\overline{\text{SEND}}$ signal at time $T_3$, the bill transporter begins sending data to the CPU 216 between times $T_4$ and $T_5$. Thereafter, the $\overline{\text{SEND}}$ signal from the CPU 216 goes to a logic 1 state at time $T_6$ and if the bill validator 230 does not receive a subsequent logic 0 $\overline{\text{SEND}}$ signal within four milliseconds, indicating that the data should not be resent, then the $\overline{\text{INTERRUPT}}$ signal goes to logic 1 at time $T_7$. If the accept enable signal remains at logic 0 for more than five milliseconds, time $T_8$, after the $\overline{\text{INTERRUPT}}$ signal goes to logic 1, then the bill is considered to have been credited by the slot machine CPU 216 and the bill transporter 232 is operated to receive the bill from the validator outlet slot 234.

Referring to Example II, the timing diagram indicates a situation where a bill is rejected by the CPU 216. In this second example times $T_2'$-$T_7'$ represent identical times $T_2$-$T_7$ as referred to with reference to Example I and will therefore not be discussed again. If within five milliseconds after the $\overline{\text{INTERRUPT}}$ signal goes to logic 1 at time $T_7'$ the $\overline{\text{ACCEPT ENABLE}}$ signal goes to logic 1, i.e. at time $T_8'$, and stays high for five milliseconds, the bill validator 230 is operable to return the bill to a user through inlet slot 232. The CPU 216 may instruct the bill transporter 230 to return the bill if, for example, a game has been started, the door 207 is open, or the denomination of the bill is not of sufficient value to permit a game to be played. For example, for a five dollar slot machine, a one dollar bill will be returned as it is insufficient to permit a game play.

Regardless of whether a bill is credited or returned, as indicated in the Examples I and II, respectively, another data message is initiated to confirm the acceptance or return of the bill, as illustrated in the CONFIRM portion of the timing diagram. Accordingly, at $T_9$, which occurs within one second after $T_7$ or $T_7'$, the $\overline{\text{INTERRUPT}}$ signal again goes to logic 0 and the CPU 216 causes the $\overline{\text{SEND}}$ signal to go to logic 1 at time $T_{10}$. Thereafter, between times $T_{11}$ and $T_{12}$, the data signal is transmitted to the CPU 216. Subsequently at time $T_{13}$ the $\overline{\text{SEND}}$ signal goes to logic 1 and at $T_{14}$ the $\overline{\text{INTERRUPT}}$ signal goes to logic 1 effectively completing a bill accept or reject operation.

Example III illustrates a situation where the CPU 216 requests that the bill $\overline{\text{DATA}}$ signal be retransmitted as when the data is improperly received. In this example, times $T_1''$-$T_6''$ represent identical times as discussed relative to times $T_1$-$T_6$ of Example I and will therefore not be discussed again. If at time $T_{6A}$, within four milliseconds after $T_6''$, the $\overline{\text{SEND}}$ signal returns to the logic 0 state, the $\overline{\text{DATA}}$ signal is retransmitted at times $T_{6B}$ through $T_{6C}$ and the $\overline{\text{SEND}}$ signal again goes to logic 1 at time $T_{6D}$. If the $\overline{\text{SEND}}$ signal then stays at logic 1 for at least four milliseconds, then at time $T_7''$ the $\overline{\text{INTERRUPT}}$ signal goes to logic 1 and at $T_8''$ the $\overline{\text{ACCEPT ENABLE}}$ signal either goes to logic 1 to reject the bill or remains at logic 0 to accept the bill as discussed above.

Figure 12:
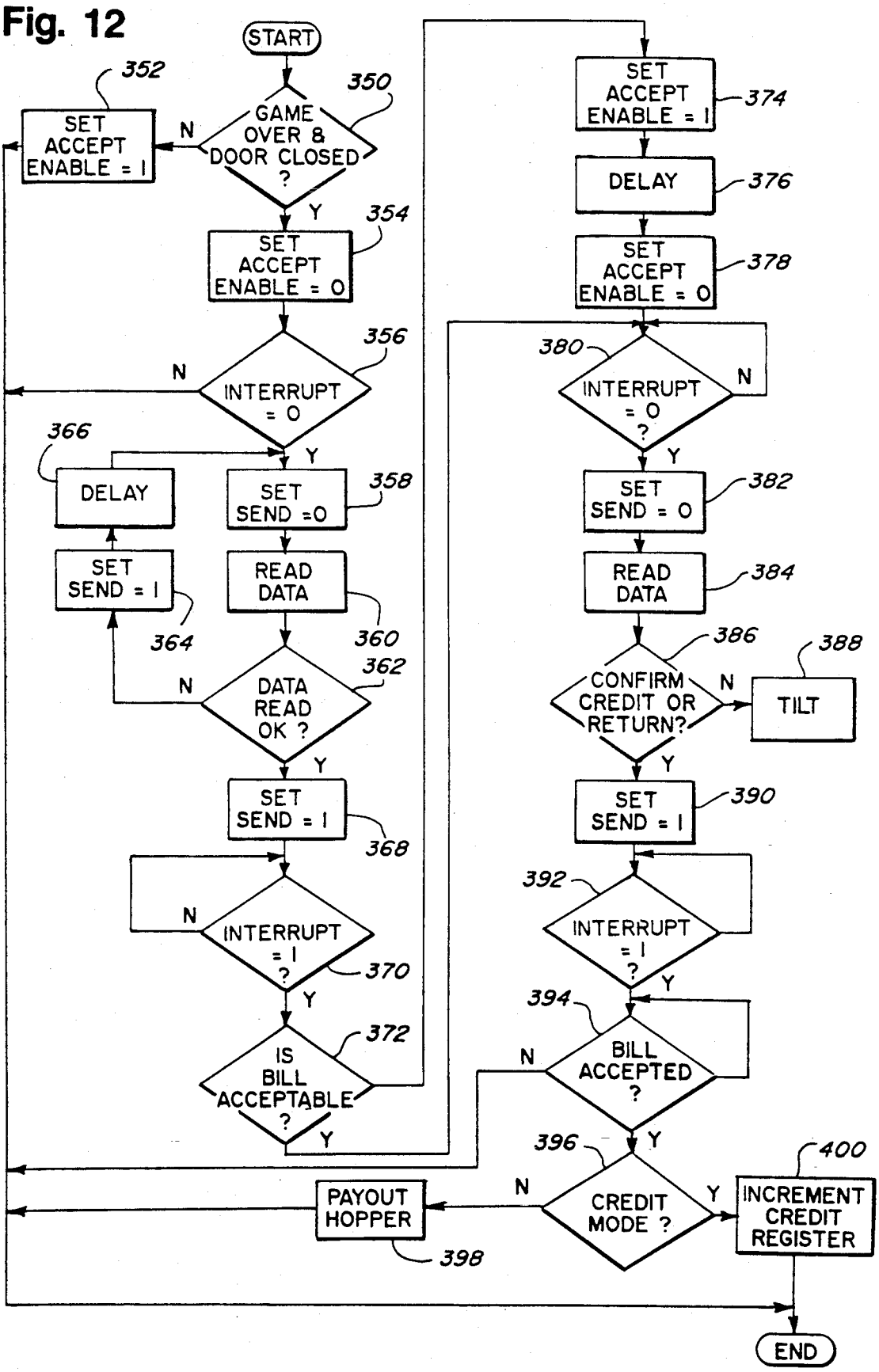
FIG. 12 is a flowchart illustrating the bill change system operation provided by the slot machine CPU illustrated in FIG. 10.

The operation of the slot machine 200 with respect to the crediting and changing of bills is described with reference to the flowchart of FIG. 12. The bill routine begins at a decision block 350 which determines whether or not the machine 200 is in a game over condition with the door 207 closed. If both conditions are not met, then the $\overline{\text{ACCEPT ENABLE}}$ signal is set equal to a logic 1 at a block 352 and the routine ends. If, however, the decision block 350 determines that the game is over and the door 207 is closed, then the $\overline{\text{ACCEPT ENABLE}}$ signal is set to equal logic 0 at a block 354. A decision block 356 then determines whether or not an $\overline{\text{INTERRUPT}}$ signal from the bill validator 230 is equal to logic 0. If the $\overline{\text{INTERRUPT}}$ signal is not equal to logic 0, indicating that no bill has been received, then the routine ends. If the $\overline{\text{INTERRUPT}}$signal is equal to logic 0, then the $\overline{\text{SEND}}$signal is set equal to logic 0 at block 358 and the $\overline{\text{DATA}}$ signal from the bill validator 230 is read at a block 360. A decision block 362 determines whether or not the data which was read was of acceptable format at block 362. If the data read is not acceptable, then the $\overline{\text{SEND}}$ signal is set to logic 1 at a block 364 and after a time delay of no more than four milliseconds at a block 366, control returns to block 358 to request a retransmission of the data signal. If the decision block 362 determines that the data was read acceptably, then the $\overline{\text{SEND}}$ signal is set equal to logic 1 at a block 368.

At a decision block 370, the control waits until the $\overline{\text{INTERRUPT}}$ signal from the bill validator 2309 is equal to logic 1. After the interrupt signal becomes equal to logic 1,then at decision block 372 the control determines whether or not the bill is acceptable. A bill is considered acceptable is the slot machine is still in a game over state with the door 207 closed, and if the bill is of sufficient denomination to permit game play, as discussed above. If the bill is not acceptable, then the $\overline{\text{ACCEPT ENABLE}}$ signal is set equal to logic 1 at a block 374, and after a delay of five milliseconds at a block 376, the $\overline{\text{ACCEPT ENABLE}}$ signal is reset to logic 0 at a block 378, in order to indicate to the bill validator 230 that the bill should be returned. If the bill is determined at block 372 to be acceptable, or after the $\overline{\text{ACCEPT ENABLE}}$ signal is set to logic 0 at block 378, control waits at a decision block 380 for the $\overline{\text{INTERRUPT}}$ signal to be equal to logic 0. Thereafter, in order to confirm the crediting or returning of the bill, the $\overline{\text{SEND}}$ signal is set equal to logic 0 at block 382 and the $\overline{\text{DATA}}$ signal from the bill validator is read at a block 384. The control then determines at a decision block 386 whether or not to confirm the credit or return. IF the transaction is not confirmed, then the machine enters a tilt mode at block 388. If the transaction is confirmed, then the $\overline{\text{SEND}}$ signal is set equal to logic 1 at a block 390, and the control waits at a decision block 392 for the $\overline{\text{INTERRUPT}}$ signal to be equal to logic 1.

Thereafter, at a decision block 394 it is determined whether or not the bill has been accepted. If the bill has not been accepted, but rather has been returned, the routine ends. If the bill has been accepted, the denomination of the bill is stored in the safe RAM 308. In the preferred embodiment of the invention the denominations of the last five bills accepted are stored in the safe RAM 308 for accounting purposes. Then, a decision block 396 determines whether or not the slot machine is set to be in a credit mode. If the machine is not set to be in a credit mode, then the machine is set to be in a change mode. In a change mode, the machine at a block 398 automatically pays out the hopper 220 responsive to the acceptance of a valid bill. The number of coins paid out through the hopper is stored in the safe RAM 308.

If, however, it is determined at the block 396 that the machine is in a credit mode, then at a block 400 the credit register is incremented by a number equal to the number of game plays associated with the denomination of the accepted bill. The number of credits defined by the denomination of the accepted bill is stored in the safe RAM 308. As a result the denominations of the last five bills accepted along with the total number of coins paid out by the hopper 220 and the number of credits resulting from the acceptance of bills is available in the safe RAM 308 for accounting purposes. Thereafter, the bill credit and change routine ends.

Figure 13:
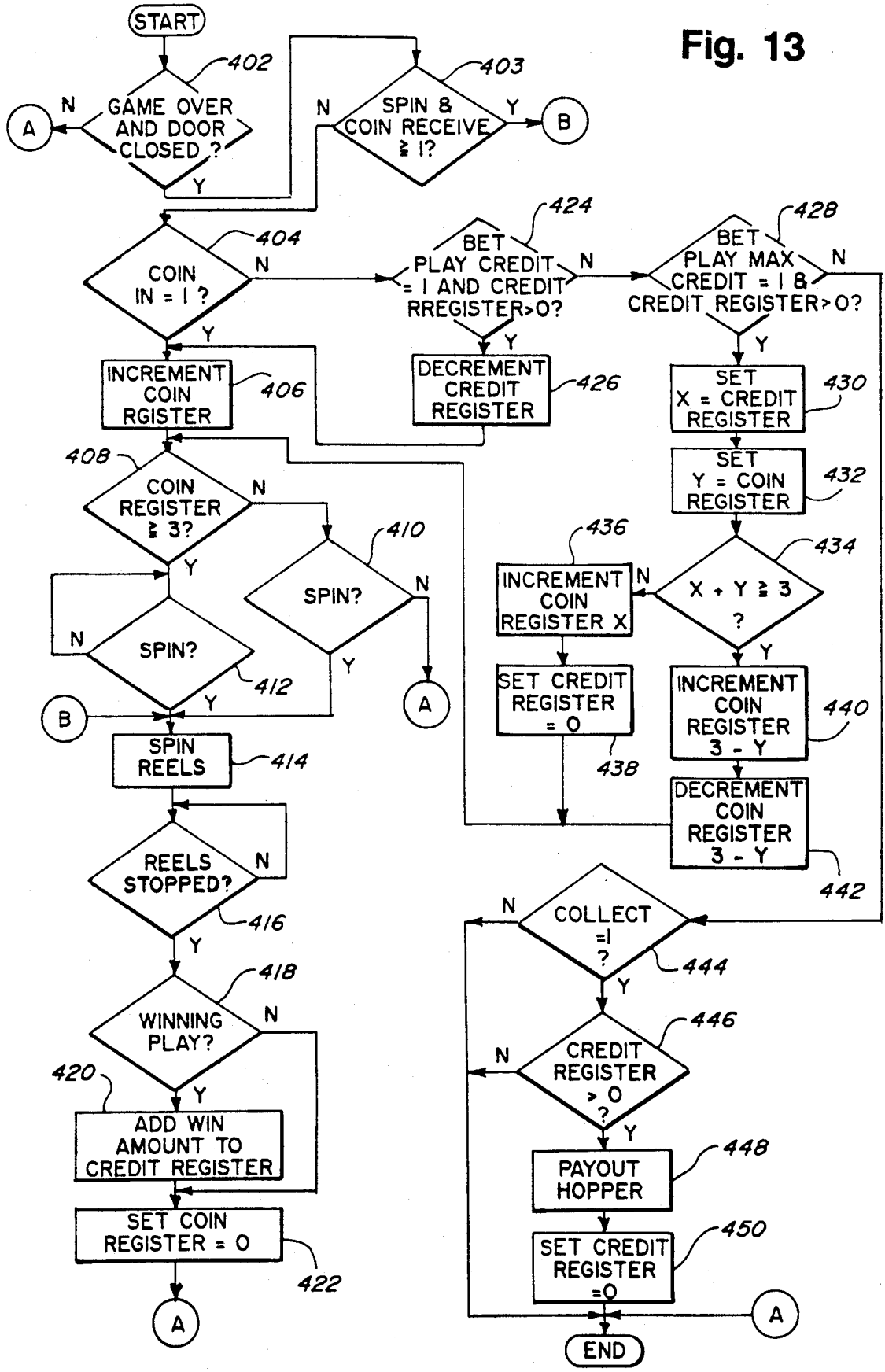
FIG. 13 is a flowchart illustrating the game control operation of the slot machine CPU illustrated in FIG. 10.

The operation of the slot machine 200 relative to the playing of a game is described with reference to the flowchart illustrated in FIG. 13. The game play routine begins at a decision block 402 where it is determined whether or not the slot machine 200 is in a game over condition and the door 207 is in a closed position. If not, game play is not permitted and the routine ends. Otherwise, a decision block 403 determines whether or not the Spin button 214 has been depressed, or the handle 212 pulled, with the Coin Register being greater than an equal to 1. If not, a decision block 404 determines whether or not a valid coin has been received through the coin slot 210 as indicated by a logic state 1. If a coin has been received, then a Coin Register is incremented by 1 at a block 406. A decision block 408 then determines whether or not the Coin Register is greater than or equal to 3, 3 being the maximum number of allowable coins playable in any one game. As will be appreciated by those skilled in the art, if a higher or lower maximum number of coins are playable in a single game, the number 3 in decision block 408 can be increased or decreased accordingly. If the Coin Register is not greater than or equal to 3, then a decision block 410 determines whether or not the handle 212 has been pulled or the Spin button 214 has been depressed. If not, then the routine ends. If the decision block 408 determines that the Coin Register is greater than or equal to 3, then the machine is not able to accept additional coins for game play and the slot machine 200 waits at a decision block 412 for the player to start a game by pulling the handle 212 or depressing the Spin button 214. If the operator has initiated a game play as determined at any of blocks 403, 410 or 412, then the reels 208 are spun at a block 414. Thereafter, control waits at a decision block 416 for the reels 208 to stop. A decision block 418 then senses the stop position of each reel 208 and determines whether or not the game play is a winning game play. If a winning play has resulted, then the winning amount is added to a Credit Register at a block 420. If a decision block 418 determines that the game is not a winning game, or the win amount has been added to the Credit Register at a block 420, then the Coin Register is set equal to 0 at a block 422 and the routine ends.

If at decision block 404, it is determined that a coin has not been inserted into the slot 210, then a decision block 424 determines if the Bet Play Credit button 224 has been depressed, as indicated by a logic 1, to play a game using credits rather than coins, and if the Credit Register is greater than 0. If both conditions are met, then the Credit Register is decremented by 1 at a block 426 and control continues on at block 406, discussed above.

If the decision block 424 determines that the Bet Credit button 224 has not been depressed, then a decision block 428 determines whether or not the Max Play Credit button 226 has been depressed and if the Credit Register is greater than 0. If both conditions are met, then at a block 430 a number X is set equal to the value in the Credit Register, and at a block 432 a number Y is set equal to the value of the Coin Register. A decision block 434 determines whether or not the sum of X and Y is greater than or equal to 3, the maximum number of coins or credits for a game play. If the sum is not greater than or equal to 3, then the Coin Register is incremented by X, namely the amount in the Credit Register, at a block 436 and the Credit Register is set equal to 0 at a block 438. Thereafter, control returns to the decision block 408. If the decision block 434 determines that the sum of X and Y is greater than or equal to 3, indicating that only a portion of the available credits can be used, then the Coin Register is incremented by the number 3 minus Y at a block 440 and the Credit Register is decremented by the number 3 minus Y at a block 442. Thereafter, control advances to the decision block 408. Accordingly, the Bet Max Play Credit button 226 is operable to use up sufficient credits so that a game is played as though it is a three coin game, whether or not coins have already been inserted or individual credits have already been used as by depressing bet play credit button 224. Similarly, if the value of the Credit Register is less than 3, then the Coin Register is incremented only by the number of credits available.

If at decision block 428 it has been determined that the Max Play Credit button 226 was not depressed, then a decision block 444 determines whether or not the Collect button 218 has been depressed. If the Collect button 218 has not been depressed, then the routine ends. Otherwise, a decision block 446 determines whether or not the Credit Register has a value greater than 0. If the Credit Register is not greater than 0, then the routine ends. If, however, the Credit Register is greater than 0, then the number of coins equal to the value of the Credit Register is paid out the chute 222 from the hopper 220 at a block 448 and the Credit Register is set equal to 0 at a block 450. Thereafter, the routine ends. If the hopper 220 does not contain sufficient coins to pay out as requested, then a light 452 at the top of the housing 202 illuminates to alert the operator to insert additional coins for payment.

Figure 14:
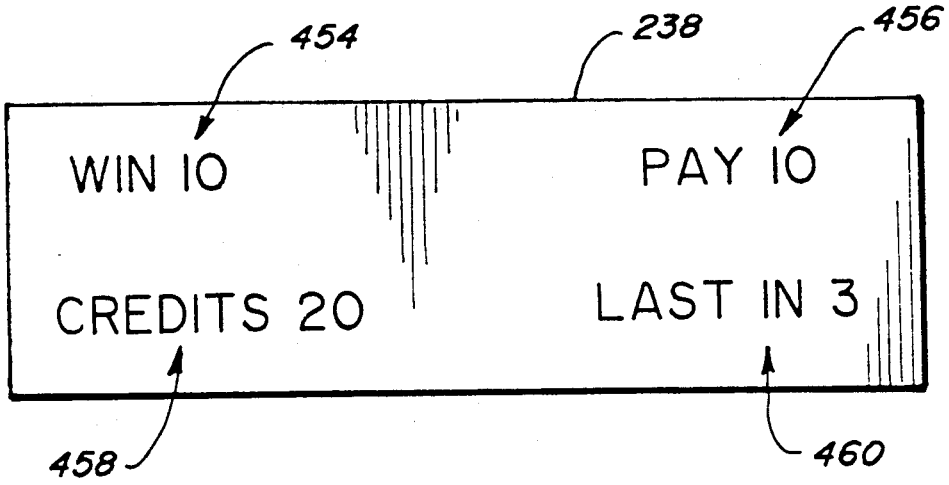
FIG. 14 is an illustration of a player information display.

Information with respect to the bills accepted by the bill validator 230 as well as game play is provided to a player by means of the alphanumeric display 238. FIG. 14 is an illustration of a typical game display where the first line of the two line alphanumeric display indicates at 454 the number of coins in a win and indicates at 456 the number of coins paid. The second line displays at 458 the number of credits remaining in the machine 200 and at 460 the number of coins used or received for the last play.

Figure 15:
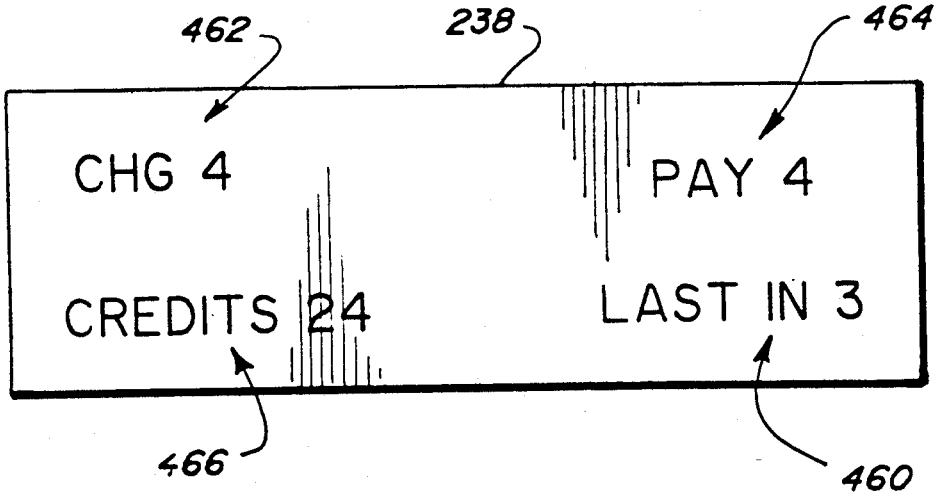
FIG. 15/ is an illustration of a player information display showing bill acceptance information.

FIG. 15 provides an example of a display generated by the CPU 216 in response to the acceptance of a bill by the bill validator 234. In the upper line the number of coins equivalent in value to the accepted bill is displayed at 462 and the number of coins paid out by the hopper 220 is displayed at 464. In the event that the machine 200 is in the credit mode, the credit display shown at 466 will be incremented by the number of credits equivalent to the denomination of the accepted bill. In this example of credit operation, the number of credits will be incremented from 20 as shown at 458 in FIG. 14 to 24 as shown at 466 in FIG. 15.

With the integrated bill validation and change system of the second embodiment of the invention, the slot machine 200 is operable to play a game responsive to the insertion of coins therein, and to add credits responsive to a winning game play. Similarly, the machine is operable to either payout a number of coins after an acceptable bill has been inserted into the machine, or alternatively add credit to the machine therefor. Any credits in the machine can be utilized to play a game, or can be paid out by requesting collection of payment.

Moreover, the slot machine 200 according to the second embodiment is operable to accept and store bills in much the same way as coins are commonly accepted, namely by storing them in a cash box in the machine stand.

The bill validation and change system of the present invention as described above allows change to be made for bills of a number of different denominations for the convenience of a slot machine player so that the player does not have to leave the machine or wait for a casino personnel when change is needed to continue playing the game. To further convenience the player, change is made only in coins having the same denomination as coins which are accepted by the slot machine to play a game. It is noted that the term coin as used herein is meant to encompass tokens which may be issued by a casino and represent a money value for which a real coin is not made or not readily available.

We claim:

1. In a gaming device having means for accepting coins of only one denomination to play a game, win means for determining a winning game play and coin storage means for storing said coins, said coin storage means being controllable to payout variable numbers of coins, a bill changing system comprising:

means for receiving bills of a plurality of denominations, said receiving means having means for identifying the denomination of a received bill;

acceptance means responsive to said bill receiving means for determining whether a received bill is acceptable, a bill being acceptable if a game is not currently being played; and means responsive to said win means and said acceptance means for controlling said storage means to payout coins of said one denomination responsive to a winning game or a received bill determined to be acceptable.

2. The gaming device of claim 1 wherein said controlling means includes:

means responsive to a determination that a received bill is acceptable for storing a number representing the number of coins necessary to change said bill;

means responsive to a coin being paid out from said storage means for signaling the payment of a coin as each coin is paid out;

means responsive to said signaling means for decrementing the number in said storing means in response to the signaled payment of a coin; and means responsive to the number in said storing means being decremented to zero for inhibiting said storage means from paying to more coins to change said bill.

3. The gaming device of claim 1 further comprising a housing having a door and a door position sensor, wherein said acceptance means is coupled to said door position sensor and said acceptance means includes means for rejecting a received bill if said door position sensor senses an open door condition.

4. In a gaming device having means for accepting coins of only one denomination to play a game, win means for determining a winning game play and coin storage means for storing coins, said coin storage means being controllable to payout variable numbers of coins, a bill changing system comprising:

means for receiving bills of a plurality of denominations, said receiving means having means for identifying the denomination of a received bill;

means for monitoring the number of coins in said storage means;

acceptance means responsive to said bill receiving means and said monitoring means for determining whether a received bill is acceptable, a bill being acceptable if there are at least a predetermined minimum number of coins in said storage means;

means responsive to said win means for controlling said storage means to payout coins of said one denomination responsive to a winning game; and player select means responsive to a player input and said acceptance means for causing said controlling means to payout the number of coins of said one denomination equivalent to the denomination of an accepted bill.

5. The gaming device of claim 4 wherein said receiving means further includes:

means for determining the validity of a received bill;

means responsive to said validity determining means and said bill acceptance determining means for rejecting bills determined to be invalid or unacceptable; and means for retaining bills determined to be valid and acceptable.

6. The gaming device of claim 4 wherein said monitoring means includes:

means for storing data representing the number of coins in said coin storage means; and means responsive to said controlling means for decrementing said data in response to each coin paid out for a winning game or an accepted bill.

7. The gaming device of claim 6 wherein said coin storage means is coupled to said coin accepting means to store accepted coins input to play a game and said monitoring means further includes means for incrementing said data in response to each coin accepted by said coin accepting means for storage in said coin storage means.

8. The gaming device of claim 4 wherein said controlling means includes:

credit means responsive to a determination that a received bill is acceptable for storing a number representing the number of coins necessary to change said bill;

means responsive to a coin being paid out from said coin storage means for signaling the payment of a coin as each coin is paid out;

means responsive to said signaling means for decrementing the number stored in said credit means in response to the signaled payment of a coin; and means responsive to said credit means being decremented to zero for inhibiting said coin storage means from paying out more coins to change said bill.

9. The gaming device of claim 8 further including means responsive to said signaling means for displaying the number of coins paid out from said coin storage means.

10. The gaming device of claim 9 further including means responsive to said signaling means for incrementing the display means each time payment of a coin is signaled to display a running count of the number of coins paid out.

11. The gaming device of claim 4 further including a display means responsive to said payout control means for depicting a running count of the number of coins paid out in responsive to said player select means.

12. The gaming device of claim 4 further including means for displaying the denomination of a received bill determined to be acceptable.

13. The gaming device of claim 4 further including means for preventing acceptance of coins by said coin accepting means after a bill is received by said receiving means.

14. In a gaming device having means for accepting coins of only one denomination to play a game, win means for determining a wining game play and coin storage means for storing said coins, said coin storage means being controllable to payout variable numbers of coins, a bill changing system comprising:

means for receiving bills of a plurality of denominations, said receiving means having means for identifying the denomination of a received bill;

acceptance means coupled to said bill receiving means for determining whether a received bill is acceptable, said receiving means being responsive to said acceptance means to retain bills determined to be acceptable and means for determining whether a game is in progress, a bill being unacceptable if a game is in progress when said bill is received;

change means responsive to said acceptance means and the denomination of an acceptable bill for determining the correct change for said bill; and means for controlling said coin storage means to payout coins of said one denomination for a wining game in response to said win means, said payout control means being responsive to said acceptance means and said change means to control said storage means to payout coins of said one denomination to change an acceptable bill retained by said receiving means.

15. The gaming device of claim 14 wherein said bill acceptance determining means includes means for monitoring the number of coins in said storage means, a bill being acceptable if said storage means has at least a predetermined number of coins therein.

16. The gaming device of claim 14 wherein said acceptance means includes means for determining the validity of a bill, a bill being unacceptable if the bill is determined to be invalid.

17. The gaming device of claim 14 wherein said acceptance means includes means for determining whether a coin has been accepted, a bill being unacceptable if a coin has been accepted before said bill is received.

18. The gaming device of claim 14 wherein said coin storage means is coupled to said coin accepting means for storing accepted coins and further including means for storing data representing the number of coins in said coin storage means; means for incrementing said data in response to each coin accepted for storage by said accepting means; and means for decrementing said data in response to each coin paid out from said storage means.

19. The gaming device of claim 18 wherein said acceptance means includes means responsive to said data for rejecting a bill for which there are insufficient coins in said coin storage means to make change.

20. In a gaming device having means for accepting coins of only one denomination to play a game and coin storage means for storing coins, said coin storage means being controllable to payout a variable number of coins, a game control and bill changing system comprising:

means for receiving bills of a plurality of denominations input to the device;

first processing means coupled to said bill receiving means for determining the validity of bills input to the device, said first processing means having means for determining the denomination of a valid bill;

second processing means for determining the denominations of bills which are acceptable, said second processing means being coupled to said first processing menas to communicate acceptable denominations thereto;

means included in said first processing means and responsive to said denomination determining means and said second processing means for controlling the bill receiving means to retain a valid bill having a denomination determined to be acceptable;

means included in said second processing means for determining a wining game play;

means included in said second processing means for controlling said coin storage means to payout coins of said one denomination in response to a winning game play determination and in response to the receipt of a valid bill having an acceptable denomination; and player select means for controlling said coin storage means to pay out in response to a player input coins of said one denomination equivalent to the receipt of a bill having an acceptable denomination.

21. In a gaming device having means for accepting coins of only one denomination to play a game and coin storage means for storing said coins, said storage means being controllable to payout a variable number of coins, a system for changing bills input to the gaming device comprising:

means for receiving a bill;

master processing means for controlling the game and payout of coins including:

means for determining a winning game play;

means responsive to a player input for determining whether change for a received bill should be made; and means for controlling said storage means to payout coins of said one denomination in response to a wining game play denomination or said determination that change should be made;

second processing means for controlling the receiving means to retain or reject received bills, said second processing means being coupled to said master processing means in a slaved relationship for communication therebetween and including:

means for determining the validity of a received bill; said second processing means controlling the receiving means to retain a valid bill in response to a determination by the master processing means that change should be made and said second processing means controlling the receiving means to reject a bill in response to a determination that the bill is not valid or that change should not be made.

22. The gaming device of claim 21 wherein said receiving means receives bills of a plurality of denominations and includes means for identifying the denomination of a received bill; said master processing means further includes means for monitoring the number of coins in said storage means; and means responsive to said monitoring means for determining for each of said bill denominations whether said storage means contains a sufficient number of coins to change a bill of that denomination, said master processing means communicating to the second processing means the bill denominations for which there are sufficient coins; and said second processing means being responsive to the bill denominations from the master processing means and to the identified denomination of a: received bill to control the receiving means to reject a bill having a denomination other than one of the bill denominations communicated from the master processing means.

23. The gaming device of claim 22 further including means controlled by said master processing means for displaying the bill denomination for which there are sufficient coins in said storage means to make change.

24. The gaming device of claim 22 further including means controlled by said master processing means for displaying the denomination of a received bill for which it is determined that change should be made.

25. The gaming device of claim 21 further including means controlled by said master processing means for displaying the number of coins paid out by said storage means.

26. In a gaming device having means for accepting coins to play a game, coin storage means for storing said coins, and means for determining a winning game play, said coin storage means being controllable to payout variable numbers of coins, a coin payout system comprising:

credit means for storing a number representative of a number of coins payable to a user;

means responsive to said determining means for incrementing the value of said credit means responsive to a winning game play;

payout means responsive to said credit means having a value greater than zero for causing said coin storage means to payout a number of coins equal to said stored number;

play means responsive to said credit means having a value greater than zero for accepting credits to play a game;

means for receiving bills of a plurality of denominations, said receiving means having means for identifying the denomination of a received bill; and select means responsive to said bill receiving means for selecting in response to a player input whether the receiving of a bill causes said credit means stored number to be incremented by a value corresponding to the denomination of the bill or operates said coin storage means to payout coins equal to said received bill.

27. The gaming device of claim 26 further comprising means for accepting a bill only if a bill is of a denomination high enough to permit game play.

28. The gaming device of claim 26 wherein said payout means comprises a user actuable collect button which causes said coin storage means to payout a number of coins equal to said stored number when said button is depressed.

29. The gaming device of claim 26 wherein said receiving means includes means for returning a bill which is determined to be unacceptable, a bill being unacceptable if a game is being played or the bill is of insufficient denomination.

30. The gaming device of claim 26 wherein said receiving means further includes:

means for determining the validity of a received bill;

means responsive to said validity determining means for rejecting bills determined to be invalid or unacceptable; and means for retaining bills determined to be valid and acceptable.

31. In a gaming device having a housing and means mounted in said housing for playing a game responsive to payment therefor, a bill acceptance system comprising:

means mounted within said housing having an inlet for receiving bills, said receiving means including validation means for determining the validity and denomination of a received bill and reject means responsive to said playing means for causing said receiving means to reject a bill prior to the determination of validity of the bill if a game is being played;

means responsive to said playing means and said validation means for accepting a valid bill; and means mounted within said housing responsive to said accepting means for transporting accepted bills from said receiving means.

32. The gaming device of claim 31 further comprising means in communication wi&:h said transporting means for storing bills transported from said bill receiving means.

33. The gaming device of claim 31 wherein said receiving means includes a bill validation determining device having an inlet slot for receiving bills and an outlet slot for forwarding bills determined to be acceptable by said accepting means.

34. The gaming device of claim 33 wherein said includes a front access door and said inlet slot extends through an opening in said front door.

35. The gaming device of claim 32 wherein said transporting means comprises an elongated conveyor defining a longitudinal passageway therethrough through which an acceptable bill is conveyed.

36. The gaming device of claim 35 wherein said conveyor includes a motor driven belt extending along said passageway for carrying an acceptable bill through said passageway.

37. The gaming device of claim 35 wherein said transporting means includes a door pivotally secured to a transporter housing, said door being selectively movable for access to said passageway.

38. The gaming device of claim 32 further comprising an access opening through a bottom wall of said housing in communication with said transporting means remote from said receiving means, said transporting means passing an acceptable bill through said opening upon the bill exiting said transporting means.

39. The gaming device of claim 38 wherein said storing means comprises a lockable stand having an opening through a top wall thereof, said top wall defining a support surface for said housing wherein said stand opening is in communication with said opening in the bottom wall of said housing for receiving bills into the stand from the transporting means.

40. The gaming device of claim 38 further comprising means for sensing the passage of a bill through said access opening.

41. In a gaming device having a housing, means for accepting coins to play a game, means for determining a winning play means for storing said coins, said accepting means, said determining means and said storing means being contained within said housing, a display system comprising:

means mounted to said housing and viewable to a user of said gaming device for displaying information to a user, said information relating to the status of a game play;

means for receiving bills of a plurality of denominations, said receiving means having means for determining the validity and denomination of a received bill;

means coupled to said receiving means and said displaying means for controlling said display means to display information relating to a received bill;

credit means for storing a credit number of coins payable to a user thereof or that alternatively can be used to play additional games, said displaying means being coupled to said credit means for displaying said credit number to a user;

player select means operatively connected to said storing means, receiving means and said controlling means for causing said credit means in response to a credit select signal to increment said credit number by an amount equal to said received bill and operating said displaying means to provide an indication of said incremented credit number of alternatively for causing storing means to pay out a number of coins equal to said received bill.

42. The gaming device of claim 41 wherein said controlling means includes means for operating said display to display information to a user relating to the validity and denomination of a received bill.

43. A gaming device comprising:

a housing;

game control means secured within said housing including a game processor, a game operating instruction memory and a game data memory operatively connected to said game processor, for controlling the operation of the gaming device;

coin input means secured to said housing and operatively connected to said game control means for accepting coins from players;

player interface means, operatively connected to said game control means for permitting players to operate the gaming device;

hopper means, secured to said housing and operatively connected to said game logic means and in communication with said coin input means, for storing coins accepted from players and dispensing coins in response to win signals from said game control means;

bill acceptor means, disposed to the gaming device and including an acceptor processor, for accepting and validating bills;

communication means operatively connected between said game processor and said acceptor processor for communicating data representing the value of a bill accepted by said acceptor means between said acceptor processor and said game processor; and means responsive to said game control means and said player interface means for causing said hopper means to dispense the number of coins equivalent to the value of the bill that has been accepted by said bill acceptance means when said player interface receives an input from a player indicating that change for said accepted bill is desired.

44. The device of claim 43 wherein said game data memory includes a current count of the number of coins in said hopper means and wherein said game control means transits a reject signal via said communication means to cause said bill acceptor means to reject a bill when said coin count is less than the value of the bill.

45. The device of claim 44 wherein said game control means is responsive to said player interface means to generate said reject signal when game play has been initiated by a player and the game play has not been completed.

46. The device of claim 44 wherein said game control means is responsive to said coin input means and is effective to generate said reject signal when a coin has been accepted for game play and the game has not been completed.

47. The device of claim 44 wherein said game control means is effective to generate said reject signal during game play.

48. The device of claim 44 wherein said game control means is effective to generate said reject signal when the gaming device is locked up in a win condition.

49. The device of claim 44 wherein said game control means includes tilt means for detecting when the gaming device is in a tilt condition and wherein said game control means is effective to generate said reject signal when the gaming device is in said tilt condition.

50. The device of claim 44 wherein said housing includes at least one door and wherein said game control means is effective to generate said reject when at least one of said doors is in an open condition.

51. The device of claim 44 wherein said game control means includes means for detecting when the gaming device is out of order and wherein said game control means is effective to generate said reject signal when the gaming device is out of order.

52. The device of claim 43 wherein said game processor additionally stores in said game data memory bill information relating to the bills accepted by said bill acceptor means.

53. The device of claim 52 wherein said bill information includes the denomination of at least one of the bills accepted.

54. The device of claim 53 wherein said bill information includes the denomination of the last five bills accepted.

55. The device of claim 52 wherein said bill information includes said number of coins dispensed by said hopper means for accepted bills.

56. The device of claim 43 additionally including means, operatively connected to said game processor, for transmitting bill information relating to the bills accepted by said bill acceptance means to an external data system.

57. The device of claim 56 wherein said bill information includes the denomination of at least one of the bills accepted.

58. The device of claim 56 wherein said bill information includes said number of coins dispensed by said hopper means for accepted bills.

59. The device of claim 43 additionally including a display operatively connected to said game processor for displaying both game information and bill acceptance information.

60. The device of claim 59 wherein said bill acceptance information includes said number of coins dispensed.

61. The device of claim 43 wherein said game control means additionally includes credit means for permitting the gaming device to be played in a credit mode whereby the count of coins credited to a player are stored in said game data memory; wherein said player interface means includes credit select means for permitting players to select the credit mode of operation and wherein said game control means inhibits said means for dispensing coins in response to the acceptance of a bill and causes said count of coins credited to be incremented by the value of the accepted bill when the credit mode has been selected.

62. The device of claim 43 wherein said acceptor processor transmits a bill accepted signal via said communication means to said game control means when a bill has been accepted by said bill acceptor means and wherein said game control means in response to said bill accepted signal causes said coin input means to reject coin inputs.

63. The device of claim 43 wherein said bill acceptor means includes a cash box and wherein said acceptor processor upon receipt of a signal from said game processor indicating that the game device is in a predetermined operating condition, causes the bill to be transferred to said cash box.

64. The device of claim 43 wherein said game control means includes means for determining if the gaming device is not in one of a predetermined set of operating conditions; wherein said gaming processor transmits an accepted enable signal to said bill acceptor means via said communication means when the gaming device is not in one or more of said predetermined operating conditions said accepted enable signal effective to enable said bill acceptor means to receive a bill.

65. The device of claim 64 wherein one of said predetermined operating conditions is that there is a game in progress.

66. The device of claim 65 wherein one of said predetermined operating conditions is that there has been a coin accepted by said coin input means.

67. The device of claim 43 wherein said game data memory contains a coin count of the number of coins in said hopper and said game processor is effective to transmit a signal via said communication means to said bill acceptor means indicating the maximum bill denomination for which coins can be dispensed.

68. The device of claim 67 wherein said bill acceptor means will reject any bills having a denomination greater than said maximum bill denomination.

69. The device of claim 68 wherein said game processor periodically polls said bill acceptor means via said communication means to determine if a bill has been accepted.

70. The device of claim 69 wherein in response to the acceptance of a bill said bill acceptor means transmits the value of any bill that has been accepted to said game processor.

71. The device of claim 61 wherein said game processor additionally stores in said game data memory bill information relating to the bills accepted by said bill acceptor means.

72. The device of claim 71 wherein said bill information includes the denomination of at least one of the bills accepted.

73. The device of claim 71 wherein said bill information includes the amount by which said count of coins has been incremented.

74. The device of claim 61 additionally including means, operatively connected to said game processor, for transmitting bill information relating to the bills accepted by said bill acceptance means to an external data system.

75. The device of claim 74 wherein said bill information includes the denomination of at least one of the bills accepted.

76. The device of claim 74 wherein said bill information includes the amount by which said count of coins has been incremented.

77. The device of claim 76 wherein said bill information includes the denomination of at least one of the bills accepted.

78. The device of claim 77 wherein said bill information includes said number of coins dispensed.

79. The device of claim 61 additionally including a display operatively connected to said game processor for displaying both game information and bill acceptance information.

80. The device of claim 79 wherein said bill acceptance information includes said count of coins credited after said count has been credited.

81. A gaming device comprising:

a housing;

game control means secured within said housing including a game processor, a game operating instruction memory and a game data memory operatively connected to said game processor, for controlling the operation of the gaming device;

coin input means secured to said housing and operatively connected to said game control means for accepting coins from players;

player interface means, operatively connected to said game control means for permitting players to operate the gaming device;

hopper means, secured to said housing and operatively connected to said game logic means and in communication with said coin input means, for storing coins accepted from players and dispensing coins in response to win signals from said game control means;

bill acceptor means, disposed to the gaming device and including an acceptor processor, for accepting and validating bills;

communication means operatively connected between said game processor and said acceptor processor for transmitting data including data representing the value of a bill accepted by said acceptor means between said acceptor processor and game processor;

credit means including a credit display, a credit count stored in said game data memory and a credit button in said player interface means, operatively connected to said game control means for operating the gaming device in a credit mode and wherein said acceptor processor responds to an accept signal form said game processor indicting that the gaming device is not in one or more predetermined operating conditions by transmitting a value signal to the game processor representing the value of an accepted bill and wherein said game processor responds to said value signal by incrementing said credit count; and wherein said game data memory stores a current count representing the number of coins in said hopper means; wherein said player interface includes means for selecting either a credit or change mode or wherein said game control means causes said hopper means to dispense the number of coins equivalent to the denomination of a bill accepted by said bill acceptor means if said current count is at least equal to the bill denomination and said change mode has been selected.

82. The device of claim 81 wherein one of said predetermined operating conditions is when a game is in progress.

83. The device of claim 81 wherein one of said predetermined operating conditions is when the gaming device is locked up in a win condition.

84. The device of claim 81 wherein one of said predetermined operating conditions is when the gaming device is in a tilt condition.

85. The device of claim 81 wherein said housing includes at leas tone door and wherein one of said predetermined operating conditions is when at least one of said doors is in an open condition.

86. The device of claim 81 wherein said bill acceptor means after accepting and validating a bill transmits data representing the value of the bill via said communication means to said game processor and wherein said current count is incremented by said game processor by an amount equivalent to the bill value.

87. The device of claim 81 wherein said bill acceptor means after accepting and validating the bill transmits data representing the value of the bill to said game data memory.

88. The device of claim 81 wherein said game processor additionally stores in said game data memory bill information relating to the bills accepted by said bill acceptor means.

89. The device of claim 88 wherein said bill information includes the denomination of at least one of the bills accepted.

90. The device of claim 89 wherein said bill information includes the amount by which said credit count has been incremented.

91. The device of claim 81 wherein said game processor stores in said game data memory said number of coins dispensed.

92. The device of claim 81 wherein said game processor additionally stores in said game data memory bill information relating to the bills accepted by said bill acceptor means.

93. The device of claim 92 wherein said bill information includes the denomination of at least one of the bills accepted.

94. The device of claim 92 wherein said bill information includes said number of coins dispensed by said hopper means for accepted bills.

95. The device of claim 81 additionally including means, operatively connected to said game processor, for transmitting bill information relating to the bills accepted by said bill acceptance means to an external data system.

96. The device of claim 95 wherein said bill information includes the denomination of at least one of the bills accepted.

97. The device of claim 95 wherein said bill information includes the amount by which said credit count has been incremented.

98. The device of claim 81 additionally including a display operatively connected to said game processor for displaying both game information and bill acceptance information.

99. The device of claim 97 wherein said bill acceptance information includes said credit count credited after said count has been incremented.

100. A gaming device comprising:

a housing;

game control means secured within said housing including a game processor, a game operating instruction memory and a game data memory operatively connected to said game processor, for controlling the operation of the gaming device;

coin input means secured to said housing and operatively connected to said game control means for accepting coins from players;

player interface means, operatively connected to said game control means for permitting players to operate the gaming device;

hopper means, secured to said housing and operatively connected to said game logic means and in communication with said coin input means, for storing coins accepted from players and dispensing coins in response to win signals from said game control means;

an inlet slot configured in said housing;

bill acceptor means, secured within said housing in communication with said inlet slot and including an acceptor processor, for accepting and validating bills;

communication means operatively connected between said game processor and said acceptor processor;

a cash box disposed to said housing;

transport means, operatively connected to said game processor, for transporting bills from said bill acceptor means to said case box;

means responsive to said game control means for causing said hopper means to dispense the number of coins equivalent to the value of a bill that has been accepted by said bill acceptor means upon receipt from said player interface means of a signal indicating that the player desires change for said accepted bill;

wherein said game processor in response to a signal received from said acceptor means via said communicating means indicating that a valid bill has been accepted causes the transport means to transport the bill from the bill acceptor means to said cash box.

101. The device of claim 100 additionally including:

a secure stand secured to the bottom of said housing; and wherein said cash box is contained within said secure stand.

102. The device of claim 100 wherein said housing includes a front door and wherein said input slot is located in said front door and said bill acceptor means is secured to an inner portion of said front door in communication with said input slot.

103. The device of claim 100 wherein said input slot is located in the front of said housing; wherein said cash box is located below said housing; wherein said hopper means is located with a lower portion of said housing and wherein said transport means extends above and behind said hopper means.

104. The device of claim 101 wherein said transport means additionally includes sensor means, operatively connected to said game processor, for generating a signal to said game processor indicating that a bill has entered said cash box.

105. The device of claim 104 wherein said sensor means includes an optical sensor located at the exit of said transport means.

* * * * *

UNITED STATES PATENT AND TRADEMARK OFFICE

CERTIFICATE OF CORRECTION

PATENT NO. : 5,113,990

DATED : May 19, 1992

INVENTOR(S) : A. J. Gabrius et al.

It is certified that error appears in the above-identified patent and that said Letters Patent is hereby corrected as shown below:

Column 2, line 67, delete "15/" and insert --15--

Column 3, line 37, this is not a new paragraph

Column 9, line 14, delete "cf" and insert --of--

Column 9, line 23, after "thereby" delete the comma ","

Column 10, line 44, delete "sc" and insert --so--

Column 12, line 27, delete "2309" and insert --230--

Column 12, line 48, delete "IF" and insert --If--

Column 15, line 58, after "paying" delete "to" and insert --out--

Column 17, line 6, delete "responsive" and insert --response--

Column 17, line 16, delete "wining" and insert --winning--

UNITED STATES PATENT AND TRADEMARK OFFICE

CERTIFICATE OF CORRECTION

PATENT NO. : 5,113,990

DATED : May 19, 1992

INVENTOR(S) : A. J. Gabrius et al.

It is certified that error appears in the above-identified patent and that said Letters Patent is hereby corrected as shown below:

Column 17, line 35, delete "wining" and insert --winning--

Column 18, line 16, delete "menas" and insert --means--

Column 18, line 25, delete "wining" and insert --winning--

Column 18, line 51, delete "wining" and insert --winning--

Column 19, line 13, delete "a:" and insert --a--

Column 20, line 29, delete "wi&:h" and insert --with--
2)

Column 20, line 37, after "said" insert --housing--

Column 21, line 22, after "user;" insert --and--

Column 24, line 38, after "means" delete the comma ","

Column 24, line 47, after "means" delete the comma ","

UNITED STATES PATENT AND TRADEMARK OFFICE

CERTIFICATE OF CORRECTION

PATENT NO. : 5,113,990

DATED : May 19, 1992

INVENTOR(S) : A. J. Gabrius et al.

It is certified that error appears in the above-identified patent and that said Letters Patent is hereby corrected as shown below:

Column 24, line 48, after "processor" delete the comma ","

Column 24, line 62, delete "form" and insert --from--

Column 25, line 5, delete "or" and insert --and--

Column 25, line 20, delete "leas tone" and insert --least one --

Signed and Sealed this

Twelfth Day of October, 1993

*Attest:*

*Attesting Officer*

Bruce Lehman

BRUCE LEHMAN

*Commissioner of Patents and Trademarks*